US005374015A

United States Patent [19]

Bezos et al.

[11] Patent Number: 5,374,015

[45] Date of Patent: Dec. 20, 1994

[54] RAILROAD TELEMETRY AND CONTROL SYSTEMS

[75] Inventors: Angel P. Bezos, Rockville; Clive Wright, Germantown, both of Md.; Emilio A. Fernandez, McLean, Va.

[73] Assignee: Pulse Electronics, Inc., Rockville, Md.

[21] Appl. No.: 122,912

[22] Filed: Sep. 16, 1993

Related U.S. Application Data

[63] Continuation-in-part of Ser. No. 983,683, Dec. 1, 1992.

[51] Int. Cl.[5] ..... B61L 23/02

[52] U.S. Cl. ..... 246/169 R; 364/426.01

[58] Field of Search ..... 246/167 R, 169 R, 182 R, 246/187 R, 187 C, 191, 185; 340/825.54, 505, 825.52; 364/426.05, 426.01

[56] References Cited

U.S. PATENT DOCUMENTS

| | | | |
|---|---|---|---|
| 3,588,186 | 6/1971 | Worbois | 246/167 R X |
| 3,696,758 | 10/1972 | Godinez, Jr. | 246/167 R X |
| 3,699,522 | 10/1972 | Haner, Jr. | 340/825.52 |
| 4,041,470 | 8/1977 | Slane et al. | 246/169 R X |
| 4,066,299 | 1/1978 | Clements . | |
| 4,574,376 | 3/1986 | Dahlqvist | 340/825.52 X |
| 4,582,280 | 4/1986 | Nichols et al. . | |
| 4,652,057 | 3/1987 | Engle et al. | 246/182 R X |
| 4,692,867 | 9/1987 | Poole | 246/187 R X |
| 4,718,271 | 1/1988 | Garland | 246/169 R X |
| 4,723,737 | 2/1988 | Mimoun | 246/167 R X |
| 4,773,001 | 9/1988 | Blair et al. | 340/825.52 |
| 4,835,693 | 5/1989 | Smith et al. | 364/426.05 X |
| 4,885,689 | 12/1989 | Kane et al. . | |
| 5,016,840 | 5/1991 | Bezos | 246/167 R X |
| 5,028,918 | 7/1991 | Giles et al. | 340/825.54 |
| 5,039,038 | 8/1991 | Nichols et al. | 246/167 R X |
| 5,142,277 | 8/1992 | Yarberry et al. | 246/169 R X |

FOREIGN PATENT DOCUMENTS

| | | | |
|---|---|---|---|
| 2587959 | 4/1987 | France | 246/169 R |
| 9111791 | 8/1991 | WIPO | 246/169 R |

OTHER PUBLICATIONS

Carlson, "AAR Undesired Emergency Brake Study", Association of American Railroads (Attachment IV).

Canadian Air Brake Club, "Tracking UDE's", Air Brake Association Convention Paper (1991).

Skantar, Elmer T., "Unintended Emergency Brake Application Indicator for Freight Trains", Tuesday Morning Session (Sep. 20, 1983).

*Primary Examiner*—Michael S. Huppert
*Assistant Examiner*—Scott L. Lowe
*Attorney, Agent, or Firm*—Whitham, Curtis, Whitham & McGinn

[57] ABSTRACT

Improvements relating to railroad telemetry and control system address problems in compatibility between HOT and EOT units, implement an automatic UDE location procedure, and automate calibration of EOT units. An improved two way protocol that allows EOT units having different code formats to be used with a HOT unit. A method is implemented by a HOT unit, cooperating with an EOT unit, for locating a fault which causes a UDE brake operation. An automatic calibration procedure for the EOT unit that does not require the operator to have access to the electronic circuitry.

6 Claims, 23 Drawing Sheets

RAILROAD TELEMETRY AND CONTROL SYSTEMS

CROSS-REFERENCE TO RELATED APPLICATION

This application is a Continuation-in-Part Application of Application Ser. No. 07/983,683 filed Dec. 1, 1992.

DESCRIPTION

BACKGROUND OF THE INVENTION

1. Field of the Invention

The present invention generally relates to improvements in railroad telemetry and control systems and, more particularly, to improvements in End of Train (EOT) units mounted on the last car of a train and Head of Train (HOT) units mounted in the cab of a locomotive, sometimes referred to as Locomotive Control Units (LCUs). An improved protocol allows EOT units having different code formats to be used with the HOT unit. The EOT unit incorporates a self-calibration feature, and the HOT unit, cooperating with the EOT unit, provides an output to the train crew indicating the approximate location of a fault in the brake system causing an Undesired Emergency (UDE) brake operation.

2. Description of the Prior Art

End of Train (EOT) signalling and monitoring equipment is now widely used, in place of cabooses, to meet operating and safety requirements of railroads. The information monitored by the EOT unit typically includes the air pressure of the brake line, battery condition, warning light operation, and train movement. This information is transmitted to the crew in the locomotive by a battery powered telemetry transmitter.

The original EOT telemetry systems were one-way systems; that is, data was periodically transmitted from the EOT unit to the Head of Train (HOT) unit in the locomotive where the information was displayed. More recently, two-way systems have been introduced wherein transmissions are made by the HOT unit to the EOT unit. In one specific application, the EOT unit controls an air valve in the brake line which can be controlled by a transmission from the HOT unit. In a one-way system, emergency application of the brakes starts at the locomotive and progresses along the brake pipe to the end of the train. This process can take significant time in a long train, and if there is a restriction in the brake pipe, the brakes .beyond the restriction may not be actuated. With a two-way system, emergency braking can be initiated at the end of the train independently of the initiation of emergency braking at the head of the train, and the process of brake application can be considerably shortened. As will be appreciated by those skilled in the art, in order for a HOT unit to communicate emergency commands to an associated EOT unit, it is desirable for the HOT unit to be "armed"; that is, authorized by railroad personnel. This is desirable to prevent one HOT unit from erroneously or maliciously actuating the emergency brakes in another train. To this end the HOT unit includes a nonvolatile memory in which a unique code identifying an EOT unit can be stored. The HOT unit also has a row of thumb wheel switches.

A logistical problem arises for various railroads which use EOT and HOT units made by different manufacturers. Although the Association of American Railroads (AAR) Communication Manual establishes standards for the communication protocol between EOT units and HOT units, those standards allow for the inclusion of discretionary information. This discretionary information is different for various manufacturers resulting in the possibility of the transmission from an EOT unit from one manufacturer having some degree of incompatibility with the HOT unit installed in the locomotive. In addition, there are currently in the field many EOT units which are of the earlier one-way transmission variety, and a number of those units use a protocol which is completely different from the AAR specification. Specifically, Pulse Electronics, Inc., the assignee of this application, has used such protocols referred to hereinafter as the PULSE protocols.

U.S. Pat. No. 4,885,689 to Kane et al. discloses a telemetry receiver which is capable of automatically recognizing certain incompatible code formats and correctly decoding received data from one-way EOT units. This telemetry receiver has been incorporated into HOT units and has provided a measure of compatibility between the EOT units of different manufactures and the HOT unit installed in a locomotive. However, further compatibility problems have arisen since the Kane et al. invention as a result of the introduction of two-way transmission systems.

Currently, there are several protocols in active use on North American railroads. These include two variants of the AAR two-way protocol, specifically one used in Canada and one used by the assignee of this application in the United States, two AAR one-way protocols differing in the discretionary bits employed, the one-way protocol implemented by the assignee of this application and described in the above-referenced Kane et al. patent, and a two-way protocol developed by the assignee of this application (i.e., the PULSE protocols). This proliferation of protocols has exacerbated the compatibility problem.

The use of EOT and HOT units has presented the possibility of solving a problem of Undesired Emergency (UDE) brake operations by assisting in the location of the fault causing the UDE. The AAR has released a study of UDEs as has the Canadian Air Brake Club, which references the work by the AAR. According to the AAR study, UDEs are normally sporadic and unpredictable, and finding the control valve which initiated the UDE is an almost impossible task. The Canadian Air Brake Club has proposed a method of determining UDE location for trains equipped with EOT units which is based on the propagation times for a pressure loss wave to reach the EOT unit and the HOT unit. Using the proposed method, an informed inspector/supervisor riding an EOT unit equipped train subject to UDEs has a simple investigative tool requiring only a stop watch, constant attention and presence of mind, according to the Canadian Air Brake Club report. The Canadian Air Brake Club also suggest that if locomotive crews developed the automatic habit of counting the seconds difference between from and rear emergency indications, the source of the UDE could also be roughly located prior to walking the train to remedy the situation. For those locomotives equipped with event recorders for after-the-fact investigation, the Canadian Air Brake Club proposes developing a "suspect car" database in order to identify and weed out marginally stable valves. This database would be developed by downloading data from event recorders which record UDEs and identifying repeat cars in the database as "suspect cars".

U.S. Pat. No. 4,066,299 to Clements discloses an apparatus for locating the origin of a UDE in a train which is based on a computation involving the time difference between when the UDE is detected at the from of the train and when it is detected at the end of the train. Thus, the Clements apparatus automates the procedure proposed by the Canadian Air Brake Club. However, the Clements apparatus, like the Canadian Air Brake Club procedure, is predicated on an assumed constant propagation rate of pressure waves which applicants have found to be a significant source of error in the calculation.

The increased reliance on EOT units in train monitoring and control means that these devices have become an indispensable safety item in the operation of trains. It is therefore important that they operate both reliably and accurately. Accurate operation requires that the EOT units be properly calibrated, and this has been done in the past by specially trained personnel. What is needed is an automatic calibration feature which would not require specially trained personnel.

SUMMARY OF THE INVENTION

It is therefore a general object of the present invention to provide improvements relating to railroad telemetry and control system which address problems in compatibility between HOT and EOT units, implement an automatic UDE location procedure, and automate calibration of EOT units.

It is another, more specific object of the invention to provide an improved two way protocol that allows EOT units having different code formats to be used with a HOT unit.

It is yet another object of the invention to provide a method implemented by a HOT unit, cooperating with an EOT unit, for accurately locating a fault which causes an undesired emergency (UDE) brake operation.

It is a further object of the invention to provide a means for calibrating the EOT unit that does not require the operator to have access to the electronic circuitry.

It is still another object of the invention to provide a new "non-ID" protocol that allows the HOT unit (locomotive control unit (LCU)) to respond correctly to any manufacturer's AAR format or a PULSE format one-way or two-way EOT equipment.

According to the invention, there is provided an improved protocol for use in End of Train and Head of Train telemetry systems which both provides compatibility of EOT units with HOT units and facilitates the location of UDEs. Using the improved protocol, a HOT unit can automatically detect whether the EOT unit attached to the rear of a train is a one-way or two-way device and the particular code format transmitted by the EOT. Similarly, a two-way EOT unit can automatically establish what type of HOT unit with which it is in communication. This is accomplished by an additional Front-to-Rear transmission which is part of the improved protocol. No operator input or other intervention is required. Furthermore, by alternate use of discretionary bits in the Rear-to-Front transmission protocol, a time stamp can be transmitted instantaneously from the EOT unit to the HOT unit in the event of a UDE. A similar time stamp is generated at the HOT unit, and the time differential between these two time stamps is used to automatically calculate the location where the UDE originated. The invention accounts for the differences in the propagation constants of the pressure waves traveling in the directions from the front of the train to the rear of the train and from the rear of the train to the front of the train. The resulting calculation for the location of the UDE is therefore more accurate that prior procedures, saving railroad personnel time. Also, in keeping with the automatic features provided with the improved protocol, the invention also provides an automatic calibration of the EOT unit, thus further adding to the reliability and functionality of the telemetry system.

In a modification of the basic invention, a new "non-ID" protocol is adaptive to the commonly known discretionary bit assignments. For example, it will correctly distinguish between an EOT sending message count or an EOT sending charge units even though both parameters use the same data field. Backwards compatibility to one-way systems and future compatibility with new EOT ID number assignments is assured since the protocol does not rely on ID assignments as a decision making criterion.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
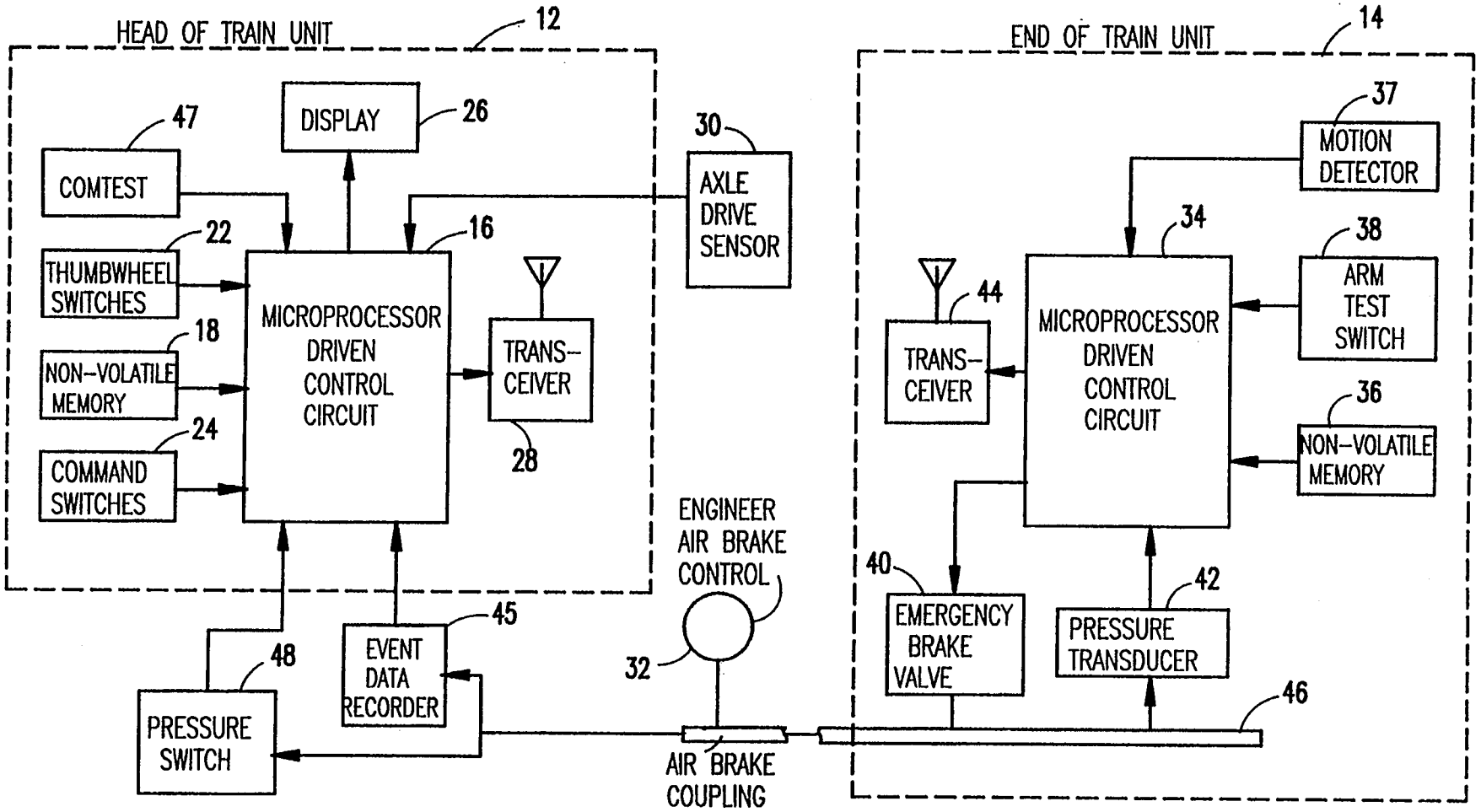
FIG. 1 is a block diagram showing the major component parts of the EOT and the HOT.

Referring now to the drawings, and more particularly to FIG. 1, there is shown a block diagram of a head of train (HOT) unit 12 and an end of train (EOT) unit 14 mechanically linked together by a train (not shown) and communicating by radio broadcast. The EOT unit 14 is typically mounted on the trailing coupler (not shown) of the last car in the train and is equipped with pressure monitoring and telemetry circuitry. A hose is connected between the train's brake pipe and the EOT unit so that the air pressure of the brake pipe at the end of the train can be monitored.

The HOT unit 12 includes microprocessor control circuit 16, a nonvolatile memory 18 which stores the control program for the microprocessor control circuit, and a series of thumb wheel switches 22 through which an operator stationed at the HOT unit can manually enter the unique code number of the EOT unit 14. In addition to inputs from the thumb wheel switches and nonvolatile memory, the microprocessor control circuit 16 also has a command switch input 24 and a communication test (COMTEST) switch input 25 and provides outputs to a display 26 and transceiver 28. A locomotive engineer controls air brakes via the normal locomotive air brake controls, indicated schematically at 32, and the normal air brake pipe 46 which extends the length of the train. Existing HOT units are connected to the locomotive's axle drive via an axle drive sensor 30 which provides typically twenty pulses per wheel revolution.

The EOT unit 14 includes a microprocessor control circuit 34, and a nonvolatile memory 36 in which the control program for the microprocessor controller and a unique identifier code of the particular EOT unit 14 are stored. The microprocessor control circuit 34 also has inputs from a motion detector 37, a manually activated arming and test switch 38 and a brake pressure responsive transducer 42 and an output to an emergency brake control unit 40 coupled to the brake pipe 46. The EOT unit 14 communicates with radio transceiver 28 of the HOT unit 12 by way of a radio transceiver 44.

In addition, at the front of the train (e.g., the locomotive) there is typically an event data recorder 45 which is coupled to the brake pipe 46 at the locomotive. An output of data recorder 45 is coupled to the HOT unit microprocessor control circuit 16 so that changes in brake pressure at the locomotive end of the brake pipe are coupled to the microprocessor control circuit 16. According to one aspect of the invention, a pressure switch 48 is also connected to the brake pipe 46 and provides an output directly to the microprocessor control circuit 16. The function of the pressure switch 48, which has a typical threshold on the order of 25 psi, is to sense and communicate to the HOT unit 12 the arrival of an emergency brake application. This information is used in the UDE location computation described below.

As described in more detail hereinafter, what is needed for UDE calculations is the establishment of the point in time at which a UDE arrived, via the brake pipe 46, to the HOT 12. This can be done by several methods. The preferred approach is to use the pressure switch 48 to detect when the pressure drops below a certain threshold. In the alternative, the pressure information being communicated by the event recorder 45 to the microprocessor control unit 16 can be used. The advantage of using the pressure switch 48 is that the UDE calculation is made independent of the event recorder 45.

As will be appreciated by those skilled in the art, the air brake pipe 46 mechanically couples the HOT unit 12 to the EOT unit 14. As disclosed in U.S. Pat. No. 4,582,280, since this mechanical coupling is unique to a particular train, it can be used by the HOT unit to verify through physical connection that the EOT is properly linked for communication.

Figure 2:
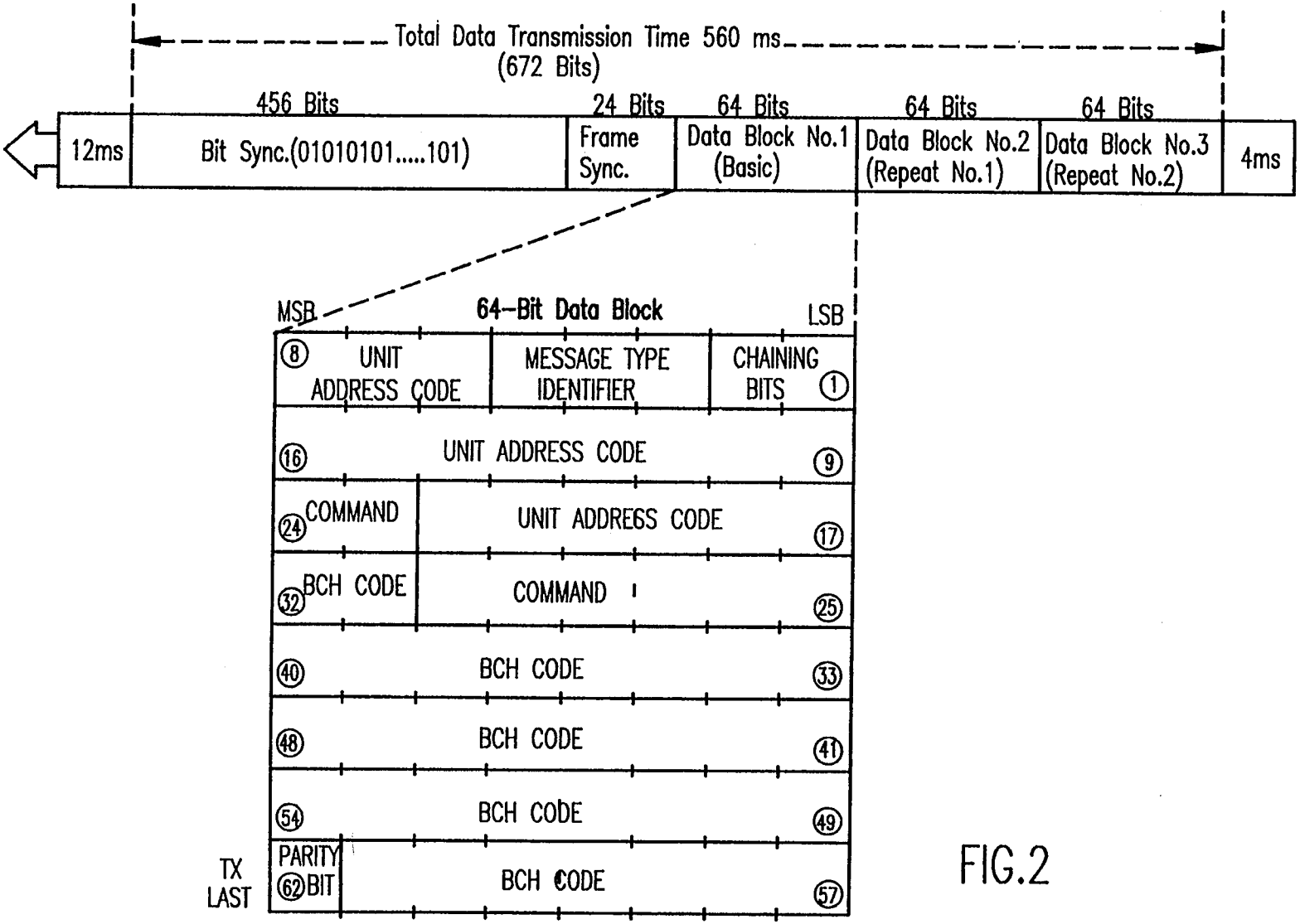
FIG. 2 is a block diagram illustrating the format of the AAR front-to-rear transmission protocol.

Two way communication is initially established between the HOT unit 12 and the EOT unit 14 using standard procedures such as those prescribed in the Association of American Railroads (AAR) Communication Manual which enable two way Communications Links testing. The format for the front-to-rear transmission according to the AAR standard is shown in FIG. 2. The total data transmission time is established as 560 milliseconds (ms) comprising 672 bits. The first 456 bits are used for bit synchronization. This is an alternating sequence of binary "1s" and "0s" and is followed by twenty-four bits for frame synchronization. The frame sync block is followed by three data blocks of sixty-four bits each, the second and third data blocks being a repetition of the first data block. This redundancy provides a measure of assurance that the data block will be correctly received and decoded by the EOT unit. The data block itself comprises a 30-bit data sequence for the information followed by a 33-bit BCH error detection code and a final odd-parity bit.

Figure 3:
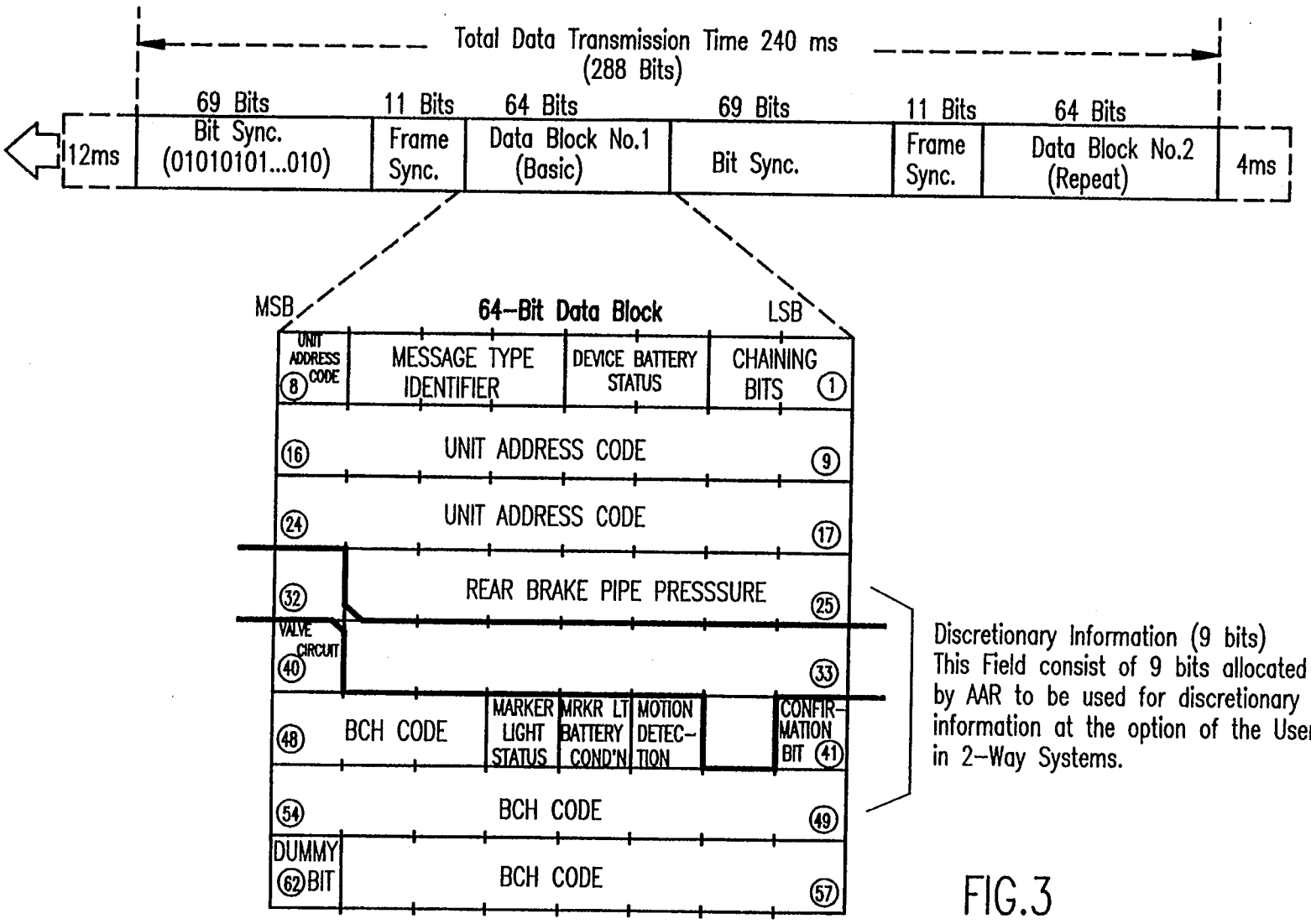
FIG. 3 is a block diagram illustrating the format of the two-way AAR rear-to-front transmission protocol.

FIG. 3 shows the format for the rear-to-front transmission according to the AAR standard. The total data transmission time is established as 240 milliseconds (ms) comprising 288 bits. The first 69 bits are used for bit synchronization and, like the bit synchronization used in the front-to-rear transmission, is an alternating sequence of binary "1s" and "0s". This is followed by eleven bits for frame synchronization and a 64-bit data block. This pattern is then repeated with 69 bits of bit synchronization, eleven bits of frame synchronization and a second 64-bit data block which is a repeat of the first data block. Again, the redundancy of the transmission is designed to improve the chances that the data block will be correctly received and decoded by the HOT unit. The data block itself comprises eight bytes. The first byte comprises two chaining bits, two bits of battery status information, three bits identifying the message type, and one bit which is part of the, unit address code. The next two bytes of data are also part of the unit address code. The fourth byte of data comprises seven bits for reporting rear brake pipe pressure and one discretionary bit. The fifth byte comprises seven bits of discretionary data and one bit defining valve circuit status. The sixth byte includes one bit used as a confirmation bit, another discretionary bit, a motion detection bit, a marker light battery condition bit, a marker light status bit, and three bits of BCH error detection code. The next byte and seven bits of the last byte are also BCH error detection code. The last bit of the last byte is not needed and is simply a dummy bit. The nine bits of discretionary information spread between the fourth, fifth and sixth bytes are allocated by the AAR to be used at the option of the user in two-way systems.

Figure 4:
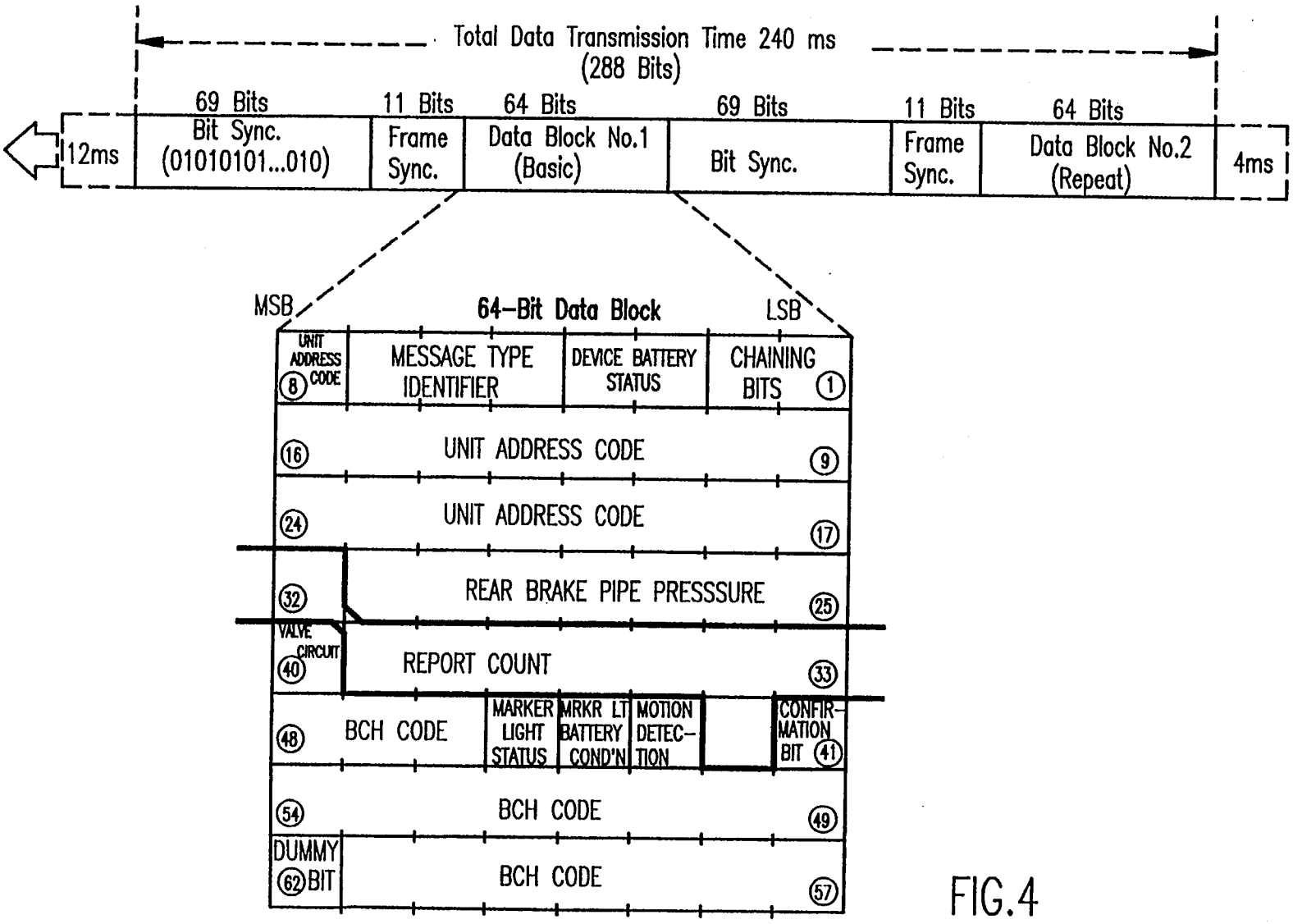
FIG. 4 is a block diagram illustrating the format of a first variant of the two-way AAR rear-to-front transmission protocol.

FIG. 4 shows the format of a first variant of AAR rear-to-front transmission two-way protocol. This variant is used by the Canadian National (CN) and Canadian Pacific (CP) Railroads. The nine bits of discretionary information are allocated as follows. The last bit of the fourth byte is for SBU (the Canadian designation of an EOT unit) status. This bit is set to zero whenever the SBU (EOT) unit has turned itself off. In Canadian systems, the SBU (EOT) unit turns itself off whenever the brake pipe pressure is zero (actually, below 5 psi) for more than five minutes. The first seven bits of the fifth byte are a report count, and the second bit of the sixth byte is a motion status bit, i.e., forward or reverse. The "count" is simply a transmission count. Each successive EOT transmission is numbered (up to the 7-bit capacity), and the number incremented by one with each transmission. At decimal count "127" (binary "1111111"), the count "wraps around"; that is, it starts again at decimal "000". This count is sometimes used to run statistical analyses of communication success rates.

Figure 5:
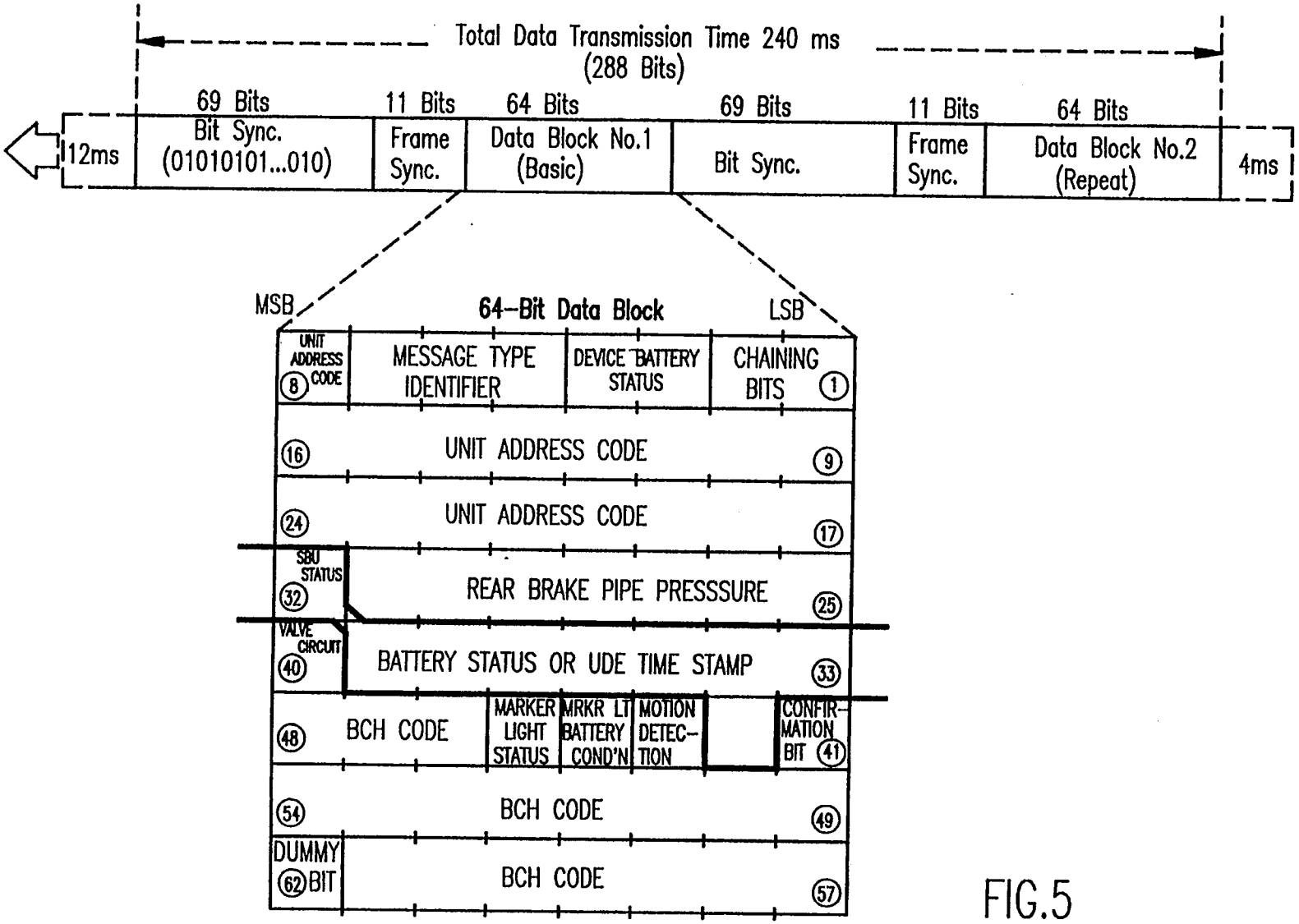
FIG. 5 is a block diagram illustrating the format of a second variant of the two-way AAR rear-to-front transmission protocol.

FIG. 5 shows the format of a second variant of AAR rear-to-front transmission two-way protocol. This variant is used by some railroads in the United States. The nine bits of discretionary information in this variant are allocated as follows. The last bit of the fourth byte is the SBU status bit, as in the format shown in FIG. 4. As will be described with reference to FIG. 6, this bit is used as a test bit in one-way EOT units manufactured by the assignee of this application, but in two-way EOT units, the fifth through seventh bits are a message identifier code which, for a code of "111", identify the message as a test initiated by pressing the test button on the EOT unit. Therefore, in the two-way EOT units, the convention of the SBU status for the last bit of the fourth byte has been adopted in this protocol.

The first seven bits of the fifth byte are data reporting information of the EOT unit. This is either battery status information or a UDE time stamp. The battery status information is a usage count which represents the amount of usage since the last recharge of the battery, thereby providing an indication of the percentage of battery life utilized. For example, a 4 amp-hour battery that has delivered 1 amp-hour would be reported as a count of 25 (percent). The UDE time stamp is automatically entered by the EOT upon detection of a UDE, as described below. The first bit of the sixth byte is a confirmation bit which, if set to a binary "1", acknowledges a two-way communication link, and the second bit of the sixth byte is used to indicate a direction of motion.

According to one aspect of the invention, when the brake pipe pressure drops below a certain threshold, say 25 psi, in less than a predetermined time, such as two seconds, both the HOT unit and the EOT unit interpret this drop in pressure as a UDE. When this condition is detected, the seven discretionary bits in the fifth byte are used as a time stamp of the detection of the event by the EOT unit. This time stamp is used at the HOT unit to compute a differential time that is used to automatically calculate the approximate location, measured from the center of the train, of the source of a UDE. Alternatively, the time stamp could be sent by adding another data block to the RF transmission as allowed by the AAR.

Figure 6:
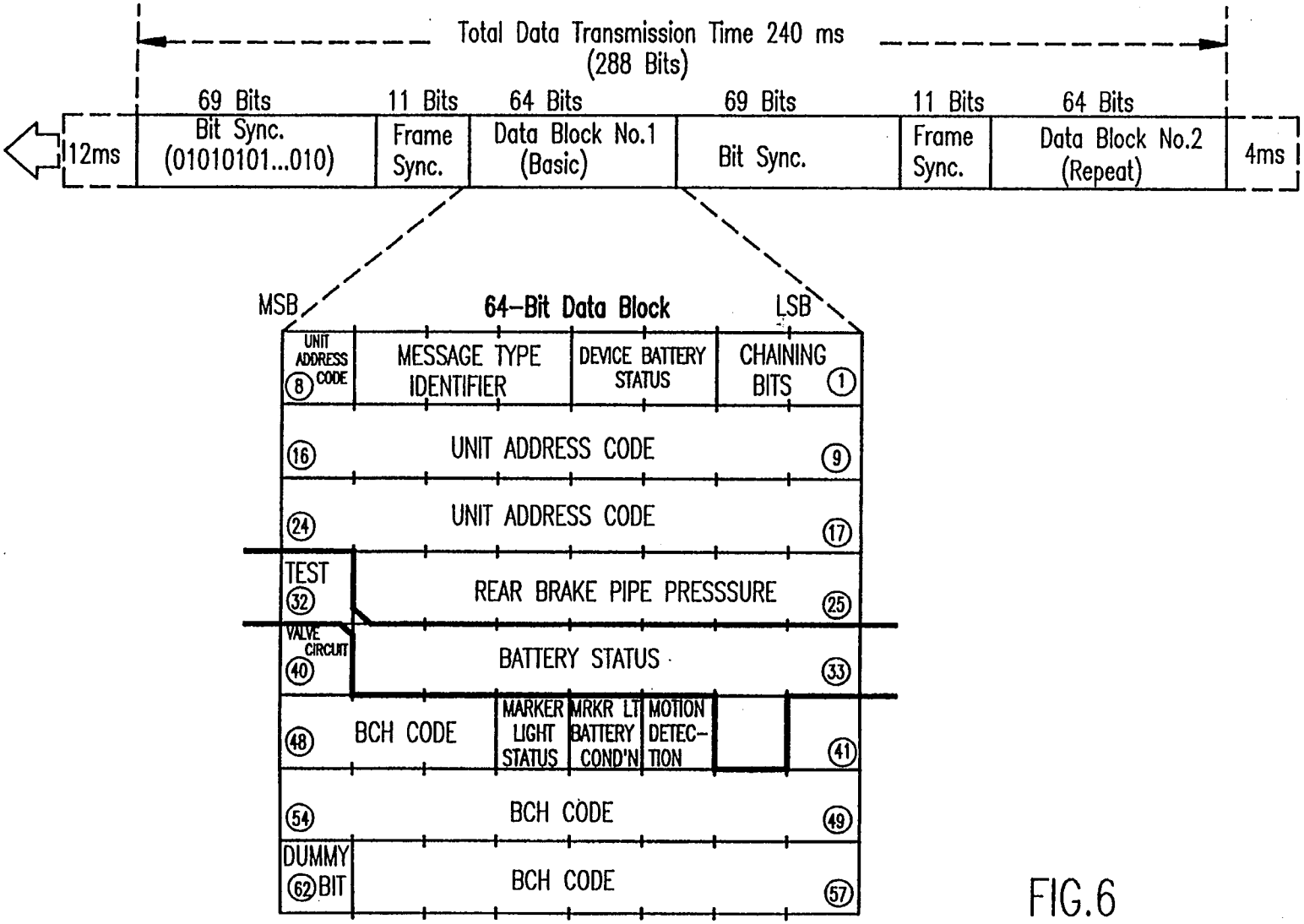
FIG. 6 is a block diagram illustrating the format of a first variant of the one-way AAR rear-to-front transmission protocol.

FIG. 6 shows the format of a one-way variant of the AAR rear-to-front protocol; that is, the EOT unit using this protocol is not capable of receiving transmissions from a HOT unit. As mentioned above in the description of the protocol shown in FIG. 5, the last bit of the fourth byte in the one-way EOT protocol used by the assignee of this application is a test bit. The test bit is set to "1" whenever an operator presses the Test Switch on the EOT unit. This tells the HOT unit that the particular transmission was originated as the result of the Test Switch being pressed. The HOT unit then displays a unique display pattern (e.g., all displays are turned "on") that alerts the HOT operator. This is a valuable feature in those units as it allows the operators to easily verify that the equipment is communicating properly.

The first seven bits of the fifth byte, similarly to that of the protocol shown in FIG. 5, are battery status information; however, since this is a one-way EOT unit, there is no UDE information. The first two bits of the sixth byte are not used and, therefore, their value is "don't care", that is, ignored. In some applications, the second bit of the sixth byte may be used to indicate a direction of motion, as in the formats shown in FIGS. 4 and 5.

Figure 7:
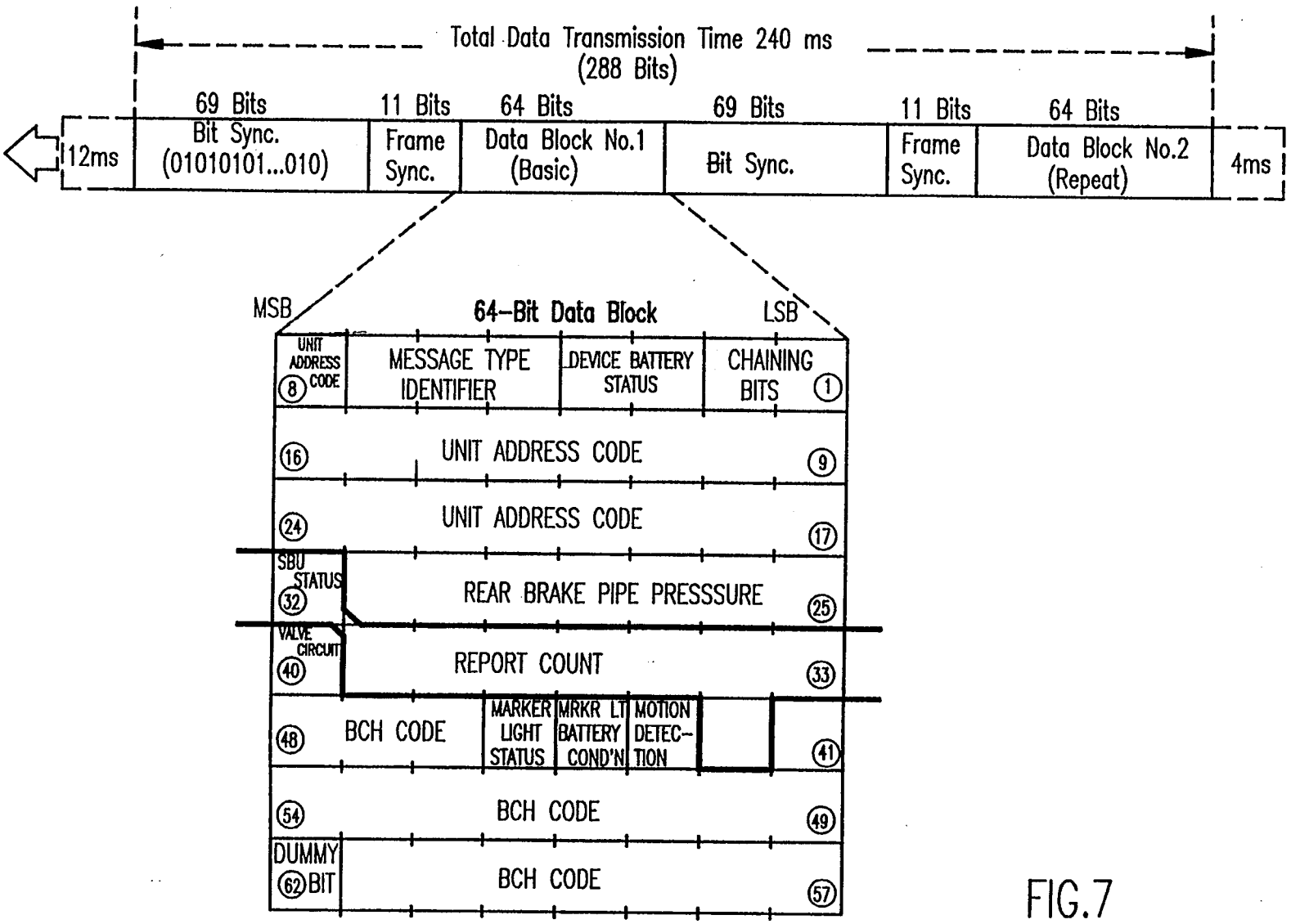
FIG. 7 is a block diagram illustrating the format of a second variant of the one-way AAR rear-to-front transmission protocol.

FIG. 7 shows another one-way variant of the AAR rear-to-front protocol, this variant being used in Canada and in some U.S. railroads. As in the formats shown in FIGS. 4 and 5, the last bit of the fourth byte is an SBU status bit, and as in the format shown in FIG. 4, the first seven bits of the fifth byte are a statistical report count. The remaining bits have the same meaning as the corresponding bits in the format shown in FIG. 6.

Figure 8:
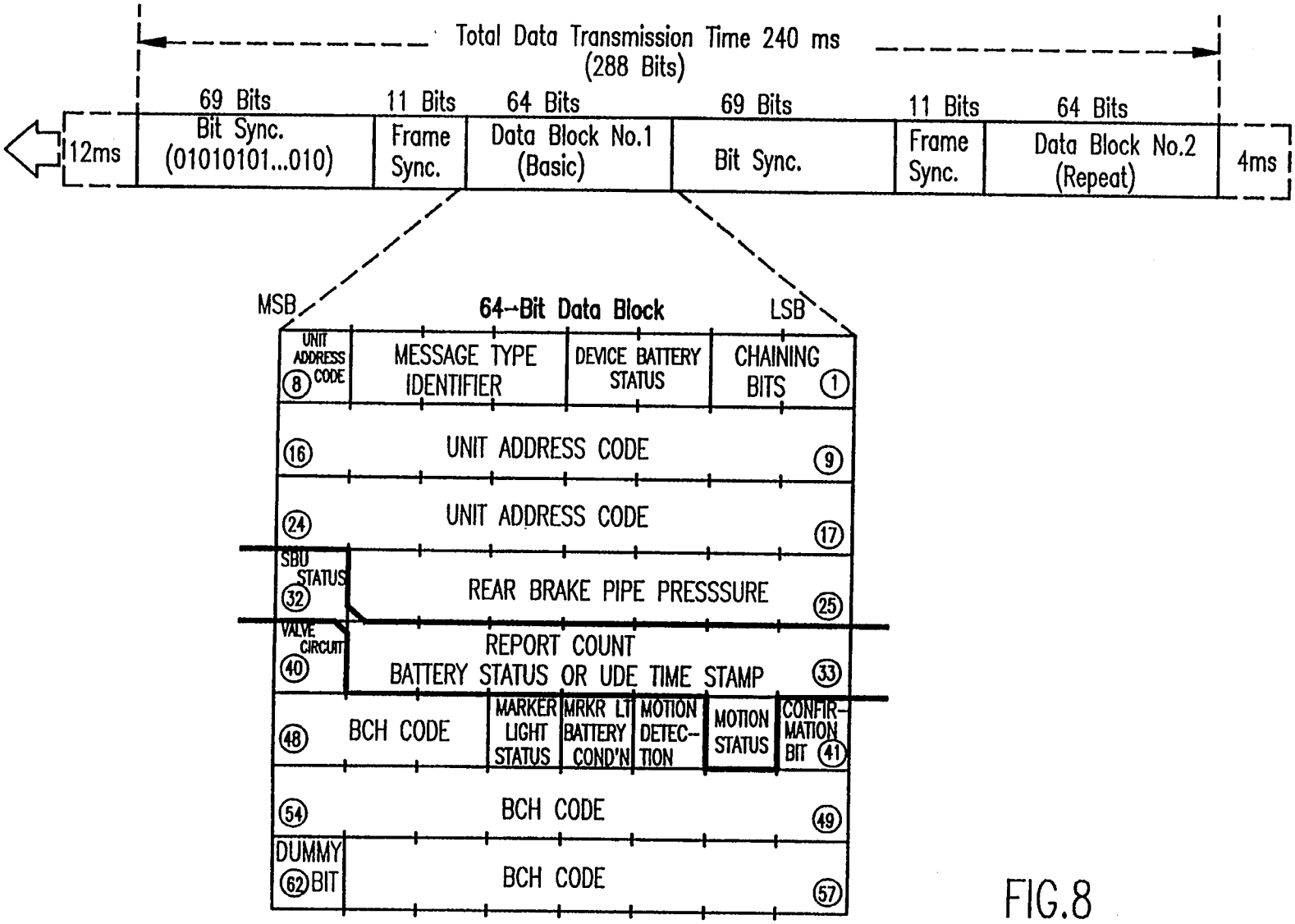
FIG. 8 is a block diagram illustrating the format of a prototype of the two-way AAR rear-to-front transmission protocol used by the invention to interpret a transmission as either the protocol shown in FIG. 4 or the protocol shown in FIG. 5.
Figure 9:
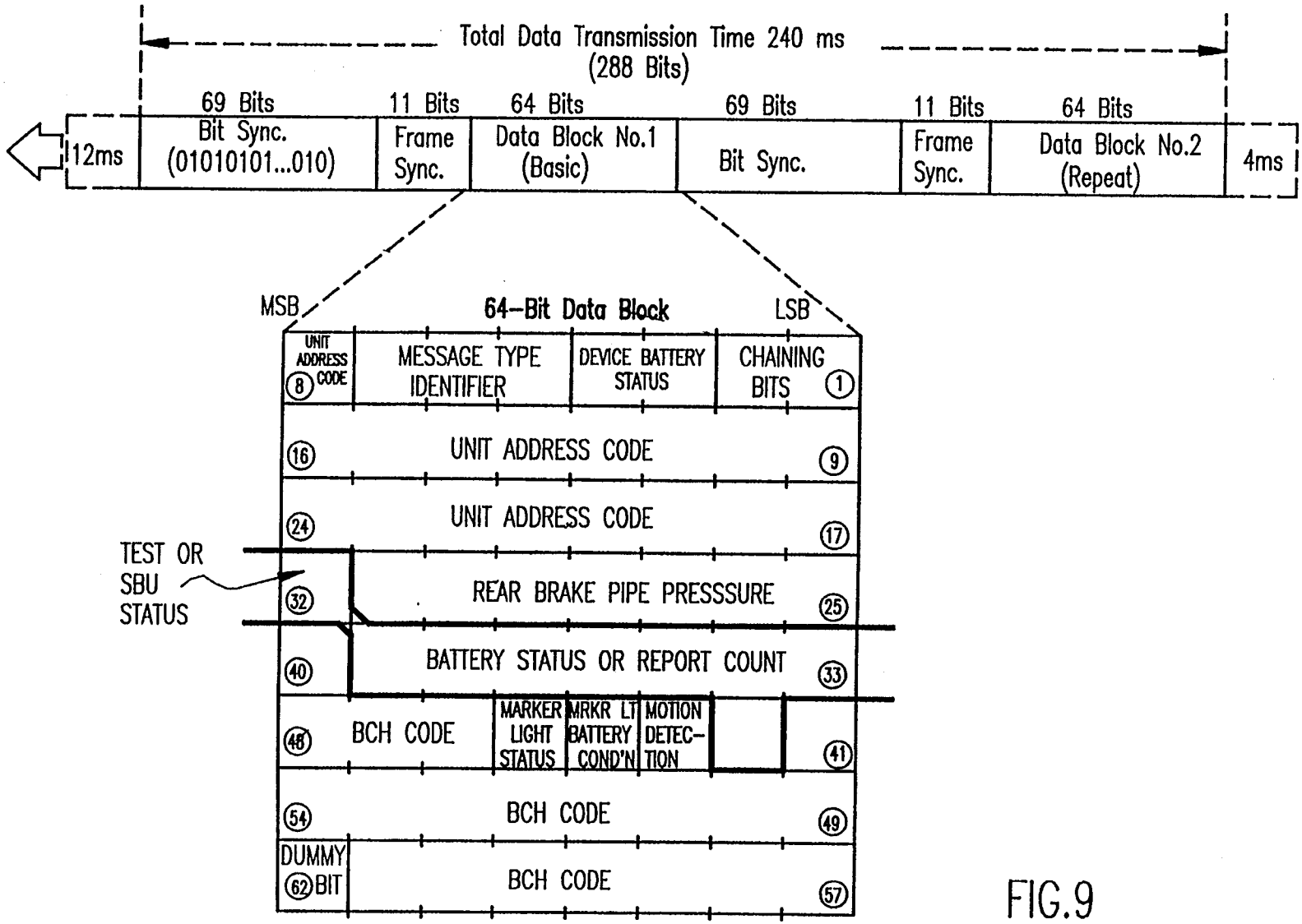
FIG. 9 is a block diagram illustrating the format of a prototype of the one-way AAR rear-to-front transmission protocol used by the invention to interpret a transmission as either the protocol shown in FIG. 6 or the protocol shown in FIG. 7.

According to one aspect of the invention, it is necessary, to be able to distinguish at the HOT unit which of the several protocols, shown in FIGS. 4 to 7, are being used by the EOT unit. For this purpose, the two prototype protocols shown in FIGS. 8 and 9 are used. In FIG. 8, the first seven bits of the fifth byte may be interpreted either as a statistical count or a battery status or a UDE time stamp. In other words, the prototype protocol is a two-way protocol which may be either of the protocols shown in FIGS. 4 or 5. The interpretation of these bits will become clear with reference to the procedure described with respect to FIG. 11. FIG. 9 shows a one-way prototype protocol which may be either of the protocols shown in FIGS. 6 or 7. Thus, the last bit of the fourth byte may be interpreted as a test bit or an SBU status bit and the seven bits of the fifth byte may be interpreted as either a statistical count or a battery status. The way in which these interpretations are made in the practice of the invention will become clear from the following discussion with reference to FIG. 11.

In addition to the formats illustrated in FIGS. 4 to 7, other formats disclosed in the aforementioned U.S. Pat. No. 4,885,689 to Kane et al. are implemented by some EOT units. Thus, the problem solved by this invention is to provide compatibility for the several codes and code formats which may be encountered on a railroad.

Figure 10:
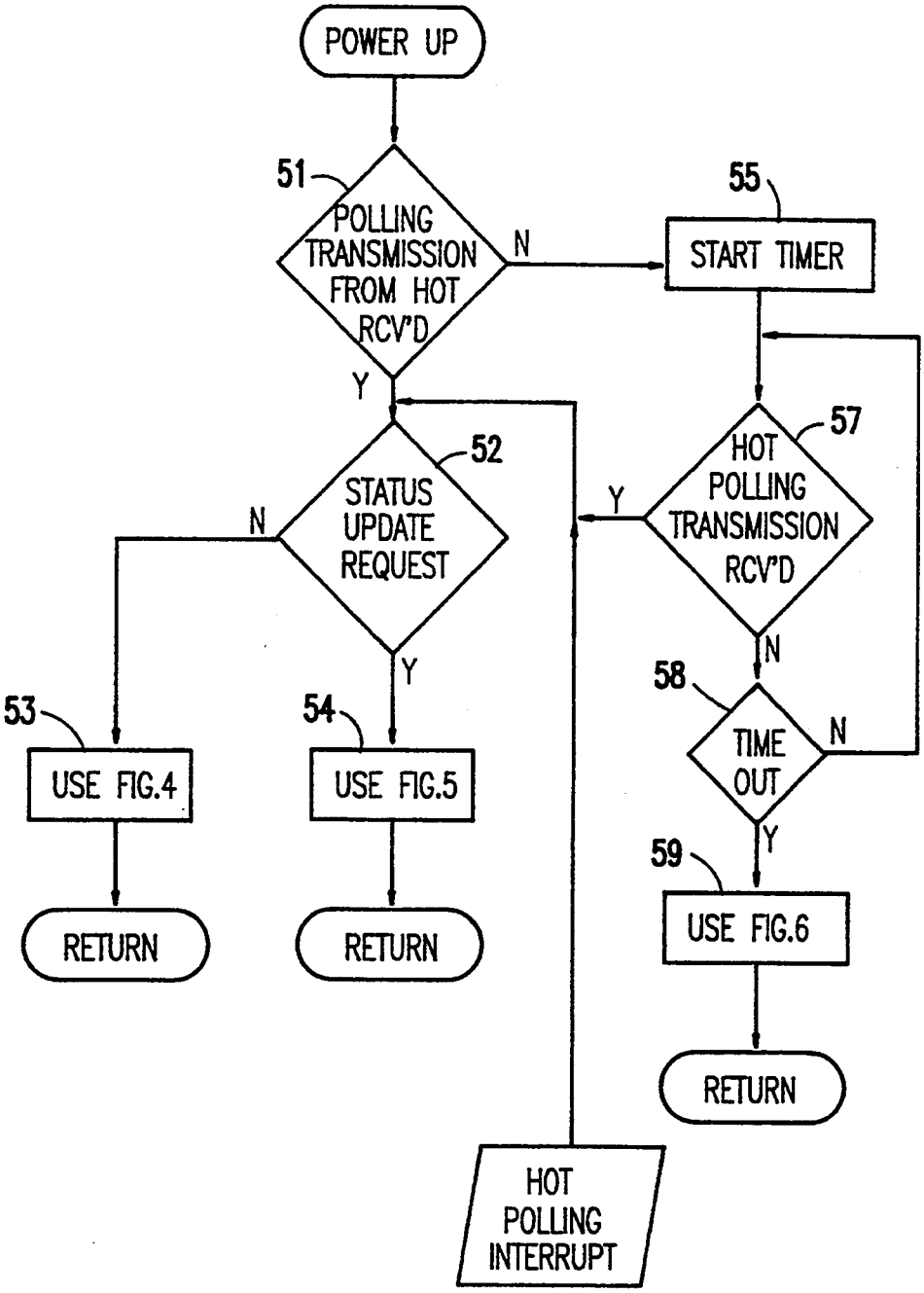
FIG. 10 is a flow diagram of EOT determination of HOT type.

FIG. 10 is a flow diagram of the two-way EOT unit determination of HOT type according to the invention. After power up, the EOT unit checks in decision block 51 to see if polling information is received from the HOT unit. If so, the polling transmission is checked in decision block 52 to determine if it has a special status update request. The HOT units manufactured by the assignee of the subject invention use a special status update request command different than the AAR standard (01 01 01 11 rather than 01 01 01 01). If the special status update request is not detected, the protocol shown in FIG. 4 is selected by the EOT unit in function block 53, and a return is made to the main program. On the other hand, if the special status update request is detected, the protocol shown in FIG. 5 is selected by the EOT unit in function block 54, and a return is made to the main program.

Returning to decision block 51, if no polling transmission received from the HOT unit, the EOT unit starts a timer in function block 55. The EOT unit continues to listen for a polling transmission from the HOT unit in decision block 57 while at the same time checking the timer for a timeout in decision block 58. Should a polling transmission be received before a timeout, the process goes to decision block 52. However, if a timeout occurs without receiving a polling transmission from the HOT unit, the EOT unit concludes that it is operating in the one-way mode and selects the protocol shown in FIG. 6 in function block 59, and a return is made to the main program. If, however, after selecting the protocol shown in FIG. 6 a polling transmission is received from the HOT unit, this polling transmission will act as an interrupt to the EOT unit microprocessor 34 shown in FIG. 1 which will call the routine shown in FIG. 10 where, in decision block 51, the polling transmission from the HOT unit will be taken as detected due to the interrupt, and the process will be entered at decision block 52.

Figure 11:
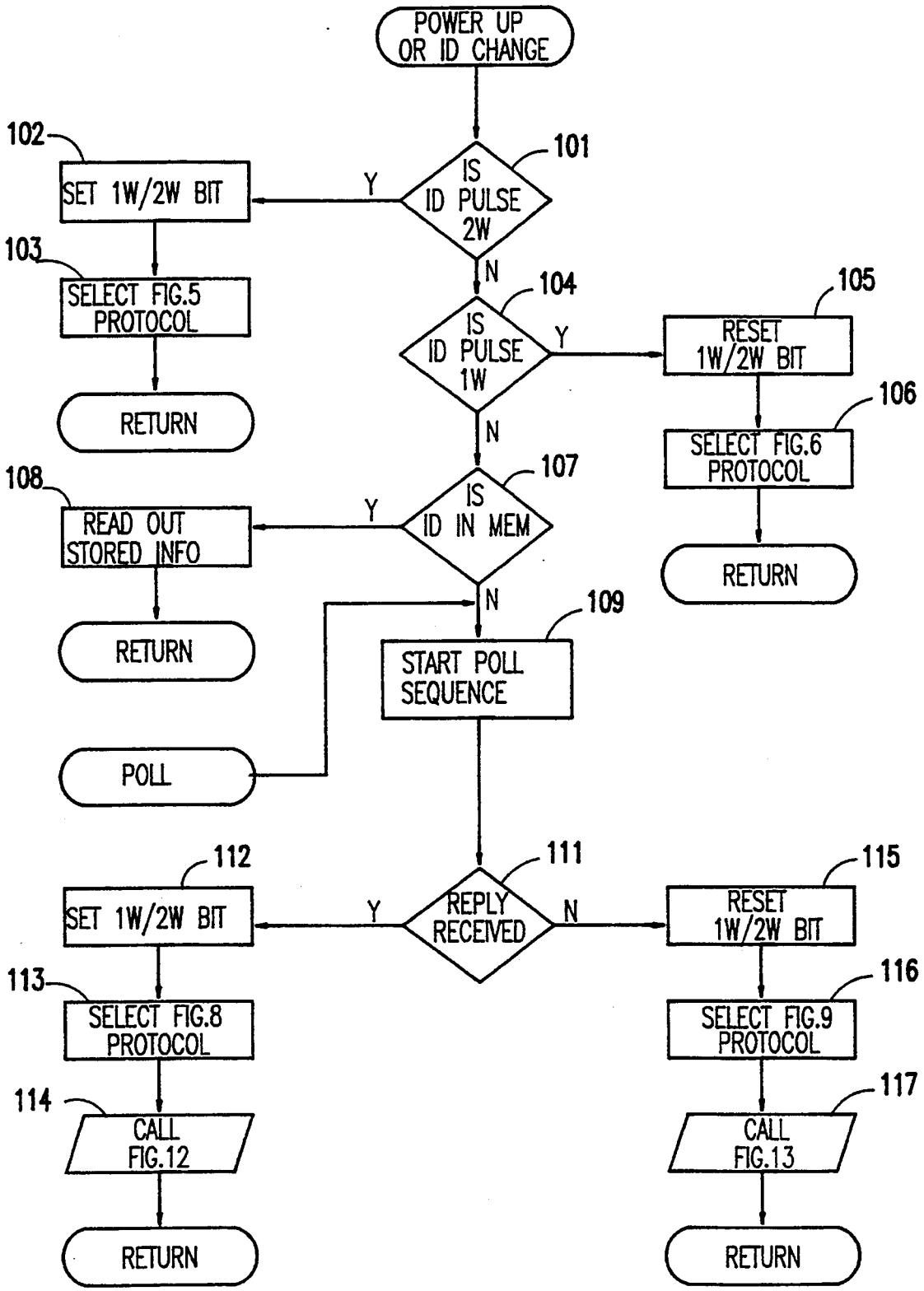
FIG. 11 is a flow diagram of the basic HOT determination EOT type.
Figure 12:
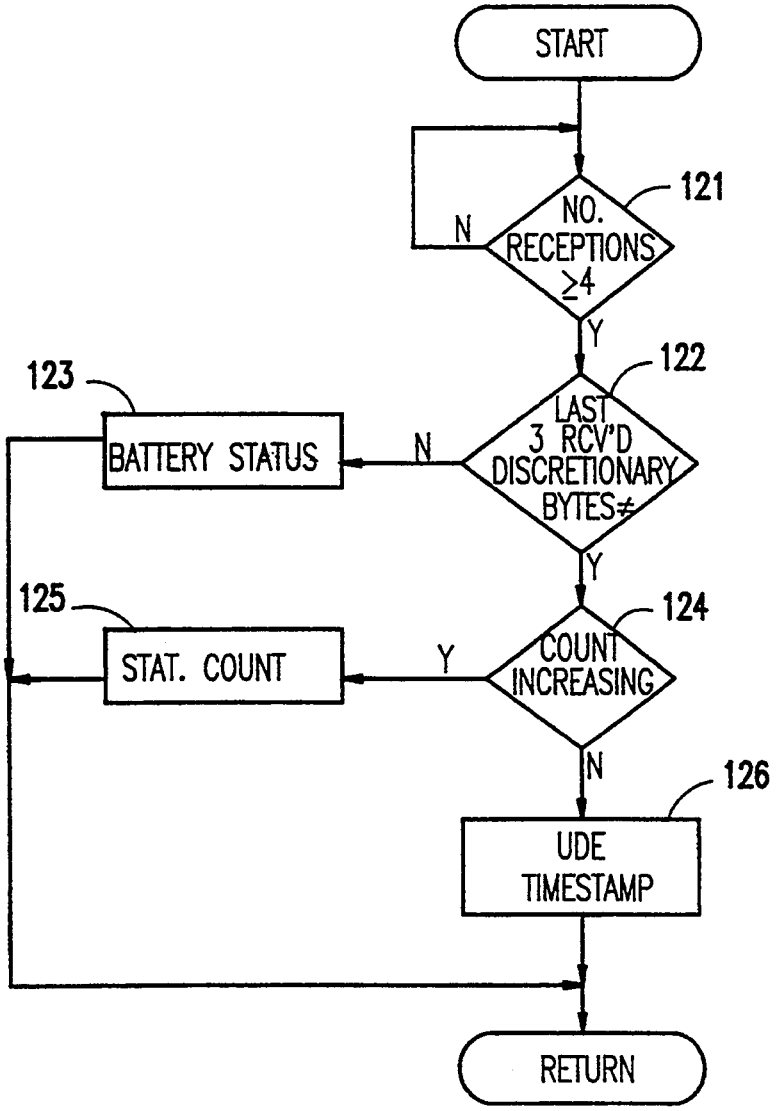
FIG. 12 is a flow diagram of the process called by the routine shown in FIG. 11 to interpret an EOT transmission as either the protocol shown in FIG. 4 or the protocol shown in FIG. 5.
Figure 13:
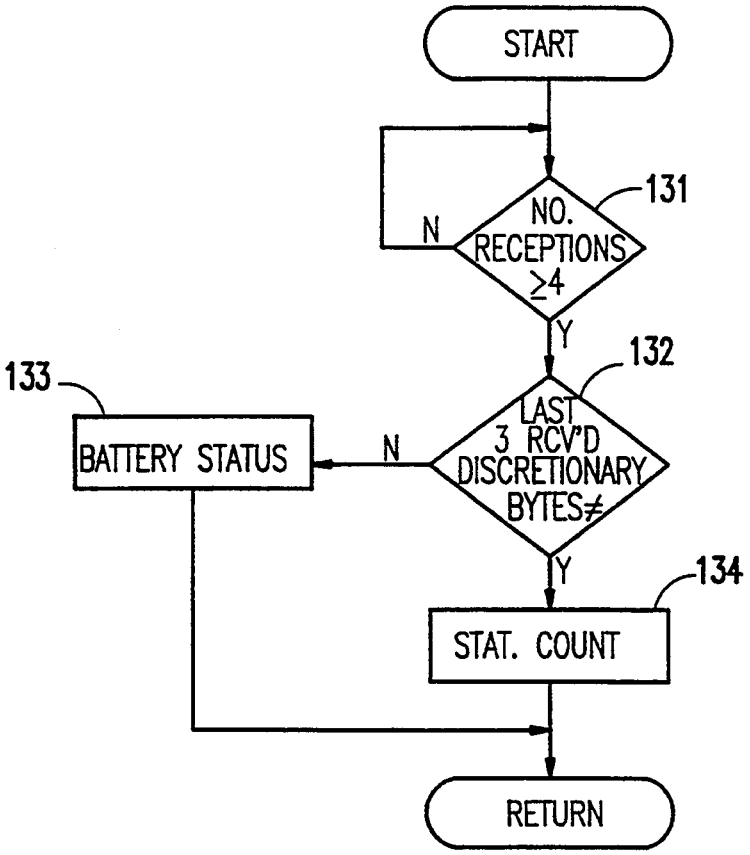
FIG. 13 is a flow diagram of the process called by the routine shown in FIG. 11 to interpret an EOT transmission as either the protocol shown in FIG. 6 or the protocol shown in FIG. 7.

FIGS. 11 to 13, taken together, are a flow diagram of HOT determination of EOT type according to the invention. FIG. 11 shows the logic used to achieve compatibility with a wide range of EOT units. The HOT unit has in nonvolatile memory the range of numbers that have previously been assigned for equipment manufactured by the assignee of this application. Whenever a number in this range is dialed in with the thumbwheel switches 22 shown in FIG. 1, the HOT unit sends the special status update request command rather than the AAR standard. Also, for this range of numbers, the HOT unit interprets the discretionary bits as defined in the protocol shown in FIG. 5. However, for numbers outside the range of numbers assigned for equipment manufactured by the assignee of this application, the HOT unit uses the standard status update request specified by the AAR and interprets the discretionary bits as defined in the protocol shown in FIG. 4 if it gets a response to its status update request (i.e., it is communicating with a two-way EOT unit not manufactured by the assignee of this application) or as defined in the protocol shown in FIG. 6 if it does not get a response (i.e., it is communicating with a one-way system).

In FIG. 11, after power up or a change in ID (dialed in by thumbwheel switches 22 shown in FIG. 1), the HOT unit checks the ID in nonvolatile memory. A determination is first made in decision block 101 as to whether the ID corresponds to a two-way EOT unit manufactured by the assignee of this application. If so, the 1W/2W (one-way, two-way) bit is set in function block 102 and the EOT protocol shown in FIG. 5 is selected in function block 103, and then a return is made to the main program. If the ID does not correspond to a two-way EOT unit, then a determination is next made in decision block 104 as to whether the ID corresponds to a one-way EOT unit manufactured by the assignee of this application. If so, the 1W/2W bit is reset in function block 105 and the EOT protocol shown in FIG. 6 is selected in function block 106, and a then return is made to the main program. If the ID does not correspond to either a two-way or a one-way EOT unit manufactured by the assignee of this application, a determination is made in decision block 107 as to whether the ID is in the nonvolatile memory corresponding to an EOT unit manufactured by another manufacturer. If the ID is in the nonvolatile memory, the information is read out in function block 108 and a return is made to the main program. This information would include, for example, whether the unit is a one-way or two-way unit and, accordingly, the 1W/2W bit is set or reset as required.

If the ID is not found in the nonvolatile memory, the HOT unit begins sending a polling sequence to the EOT unit in function block 109. If a reply is received as determined in decision block 111, the 1W/2W bit is set in function block 112 and the prototype EOT protocol shown in FIG. 8 is selected in function block 113. The FIG. 8 prototype protocol, however, requires further processing and, specifically, it is necessary to interpret the first seven bits of the fifth byte of the protocol to determine whether those bits represent a statistical count, as in protocol of FIG. 4, or either a battery status or UDE time stamp, as in the protocol of FIG. 5. This is determined by calling the process 114 shown in FIG. 12.

With reference now to FIG. 12, the flow chart shows the logic for the detection of either statistical status, battery condition or UDE information in the first seven bits of the fifth byte of the data. A determination is made in decision block 121 to determine if the number of receptions is greater than or equal to four. If so, a further test is made in decision block 122 to determine if the last three received transmissions have discretionary bits which are different by at least one bit. If not, that is the last three received discretionary bits have not changed, the discretionary bits are declared to be battery status information in function block 123, and the protocol shown in FIG. 5 is used. On the other hand, if the discretionary bits have changed frown one transmission to the next, a further test is made in decision block 124 to determine if the seven bits represent an increasing count or a decreasing count. If an increasing count, then the discretionary bits are declared to be a statistical count in function block 125, and the protocol shown in FIG. 4 is used; however, a decreasing count results in the discretionary bits being declared to be a UDE time stamp in function block 126, and the protocol shown in FIG. 5.

Returning to FIG. 11, if no reply is received as determined by decision block 111, the 1W/2W bit is reset in function block 115 and the EOT prototype protocol shown in FIG. 9 is selected in function block 116. The FIG. 9 prototype protocol, however, like the FIG. 8 protocol, requires further processing and, specifically, it is necessary to determine whether the last bit of the fourth byte is a test bit or an SBU status bit and how the first seven bits of the fifth byte should be interpreted. This is determined by calling the process 117 shown in FIG. 13.

Referring now to FIG. 13, the flow chart shows the logic for the detection of either statistical status or battery condition information in the first seven bits of the fifth byte of the data. A determination is made in decision block 131 to determine if the number of receptions is greater than or equal to four. If so, a further test is made in decision block 132 to determine if the last three received transmissions have discretionary bits which are different by at least one bit. If not, that is the last three received discretionary bits have not changed, the discretionary bits are declared to be battery status information in function block 133, and the protocol shown in FIG. 6 is used. On the other hand, if the discretionary bits have changed from one transmission to the next, then the discretionary bits are declared to be a statistical count in function block 134, and the protocol shown in FIG. 7 is used.

Periodically, the HOT unit polls the EOT unit. When a determination is made in the main program that it is time to poll the EOT unit, a front-to-rear polling message is transmitted by the HOT unit to the EOT unit in function block 109. This tests the EOT unit to determine if it is a two-way unit. The rest of the process is as described above with either the 1W/2W bit being set or reset depending on whether it is determined if the EOT unit is a two-way or one-way unit. It will be observed, however, that one modification to the system would be eliminate the process prior to decision block 109 since the HOT unit is capable of making a determination of the correct protocol by interpreting the code received. The preferred embodiment incorporates the ID memory which minimizes the processing required by the HOT unit.

In a further variant of the invention, a new "non-ID" protocol allows the HOT unit to respond correctly to any manufacturer's AAR format or PULSE format one-way or two-way EOT equipment. The HOT unit first determines if EOT unit transmissions are one-way or two-way by the following procedure. First, on receipt of the first transmission from the EOT unit, the HOT unit sends a poll to the EOT unit. If a reply is not received, the Hot assumes one-way operation. If at anytime a reply is received to a poll or a communication test (COM TEST) or an emergency, two-way operation is assumed. If two-way operation is found, the HOT unit will not revert to one-way operation even if no replies are received to subsequent polls or COM TESTs.

If a one-way EOT unit is found, the HOT unit treats the most significant bit (MSB) of the pressure byte as a TEST bit. The Hot performs the "Display Test" function on receipt of an EOT transmission with this bit set. The "Valve Fail" alarm message is suppressed.

If a two-way EOT unit is found, the HOT unit treats the MSB of the pressure byte as a NO AIR bit. If this bit is set, the HOT unit enters the "NO AIR" mode; that is, polling and communications failure alarms are suspended. The "Valve Fail" message is allowed. The message tape ID of "111" is used to initiate (i.e., trigger) a Test sequence. This is the same function as the one-way test bit supra.

Figure 14:
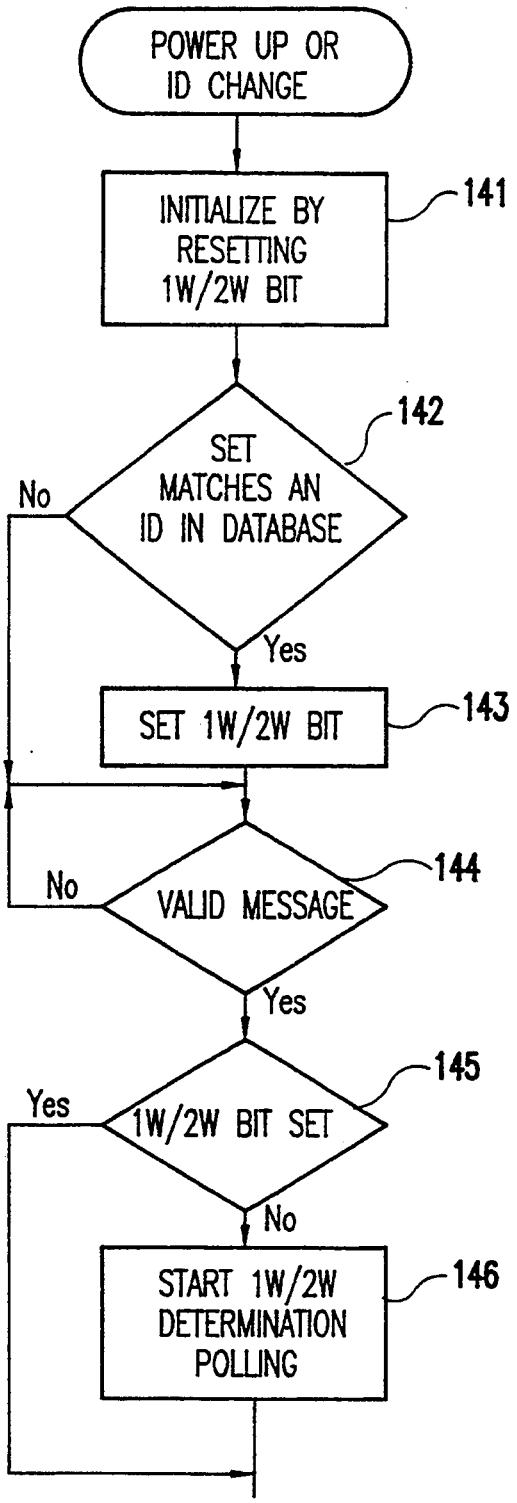
FIG. 14 is a flow diagram of the first pan of the process for an alternate "non-ID" protocol of the HOT determination of EOT type.

The implementation of this new "non-ID" protocol is illustrated in the flow diagrams of FIGS. 14 to 17. Referring first to FIG. 14, at power up or as a result of a an ID change, the system is initialized in function block 141 by accepting the default condition that the EOT is a one-way device. A test is then made in decision block 142 determine if the EOT ID matches an ID in the two-way EOT ID database. If so, the 1W/2W bit is set in function block 143 to identify the EOT as a two-way device; otherwise, this bit is left in its reset, or default, condition. Note that the selection of one-way as the default state is arbitrary. In some systems, the default could be two-way or even a "don't know" state.

During operation, the HOT unit listens for messages from the EOT unit. If a valid message is received, as determined by decision block 144, then a test is made of the 1W/2W bit to determine if it is set. If not, the Hot starts 1W/2W determination polling in function block 145. This procedure is shown in more detail in FIG. 15, to which reference is now made.

The 1W/2W determination polling begins by sending a poll to the EOT every 15 seconds in function block 151. Between polls, the Hot listens for a valid poll response, as indicated by decision block 152. If no valid poll response is received, then a count of the number of polls transmitted is made in decision block 153. If the count equals 40, the process stops, but if the count is less than 40, the process loops back to function block 151 to send another poll to the EOT unit. Assuming that a valid poll response is received, as determined by decision block 152, a further test is made in decision block 154 to determine if the number of valid poll responses is greater than or equal to three successive polls or if the valid poll responses is greater than 50% of the total number of polls transmitted. If not, the process loops back to decision block 153, but if the test criteria is satisfied, the 1W/2W bit is set in function block 155, and the procedure stops.

Figure 15:
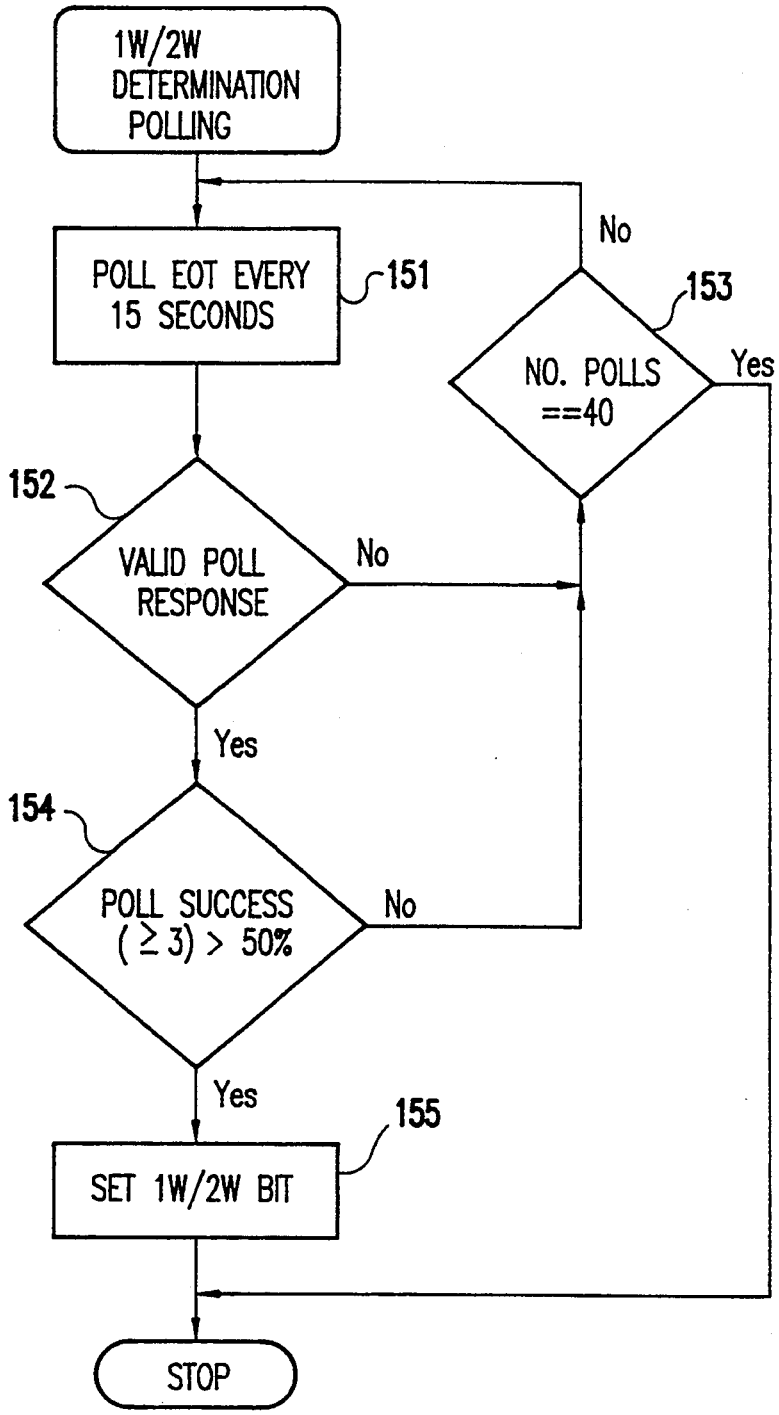
FIG. 15 is a flow diagram of the one way/two way (1W/2W) EOT determination process called by the process of FIG. 14.
Figure 16:
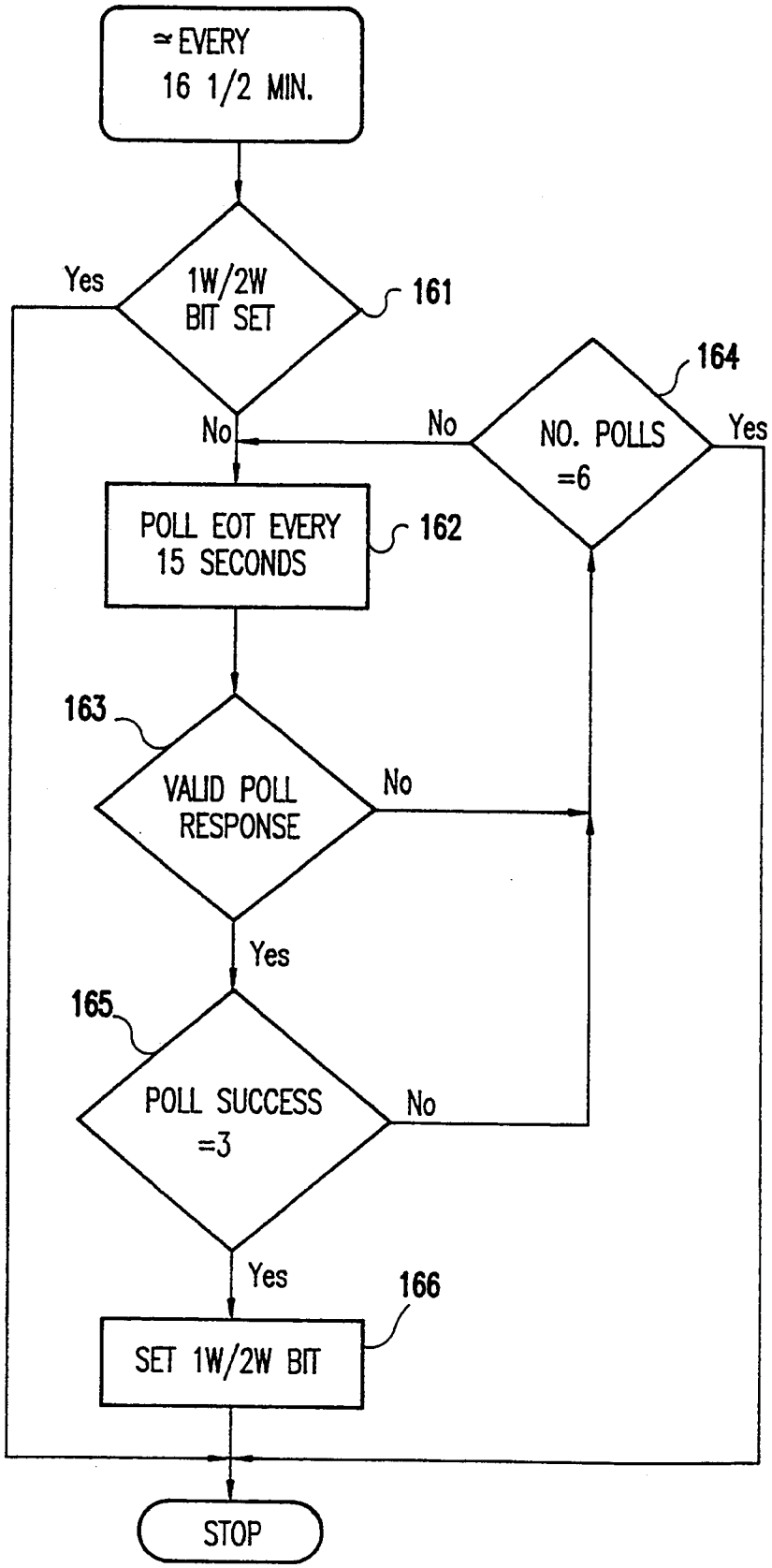
FIG. 16 is a flow diagram of the second pan of the process for the alternate "non-ID" protocol of the HOT determination of EOT type

Periodically (approximately every 16½ minutes, in a preferred implementation), the procedure shown in FIG. 16 is called. A test is made in decision block 161 to determine if the 1W/2W bit is set. If it is, a return is made to the main program; however, if the 1W/2W bit is still in its reset, or default, condition, then a procedure similar to that described for FIG. 15 is called. More particularly, a poll is sent by the Hot to the EOT every 15 seconds in function block 162. If a valid response is not received in the interval between polls, as determined by decision block 163, then a test is made in decision block 164 to determine if the count of polls equals six. If not, the process loops back to function block 162 to send another poll; otherwise the process stops. When a valid response is received, a test is made in decision block 165 to determine if the count of successful polls equals three. If not, the process loops back to decision block 164, but if so, the 1W/2W bit is set in function block 166 indicating that the EOT unit is a two-way device.

Figure 17:
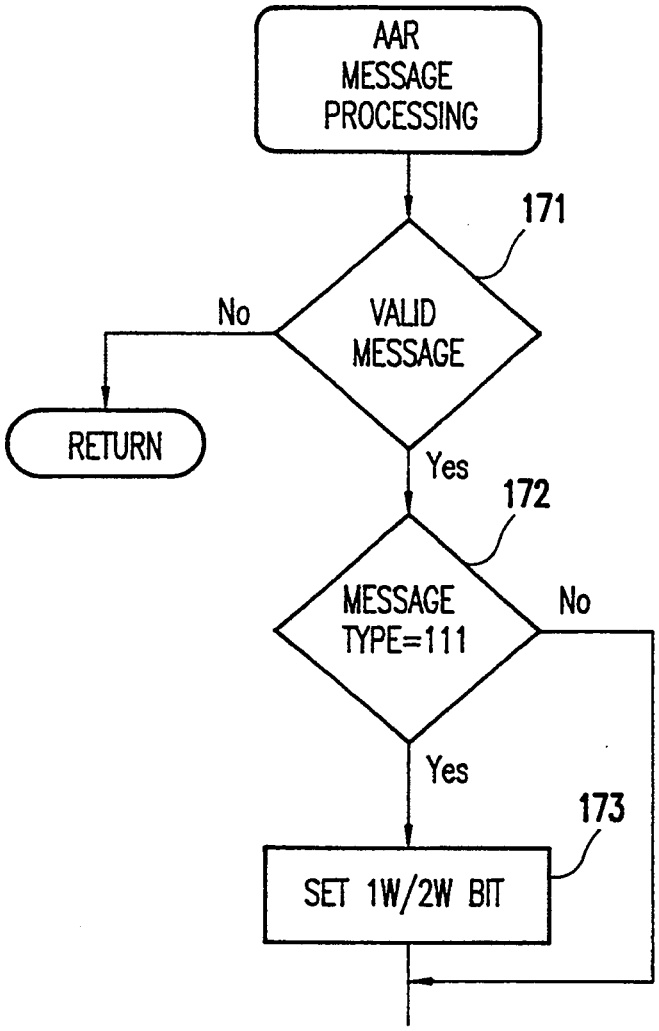
FIG. 17 is a flow diagram of the third pan of the process for the alternate "non-ID" protocol of the HOT determination of EOT type.

A further procedure for detecting a two-way EOT device is illustrated in FIG. 17. Whenever an AAR message is being processed, a valid message is determined, as indicated by decision block 171, a test is made in decision block 172 to determine if the message type identifier is a "111" If so, the 1W/2W bit is set in function block 173.

Figure 18:
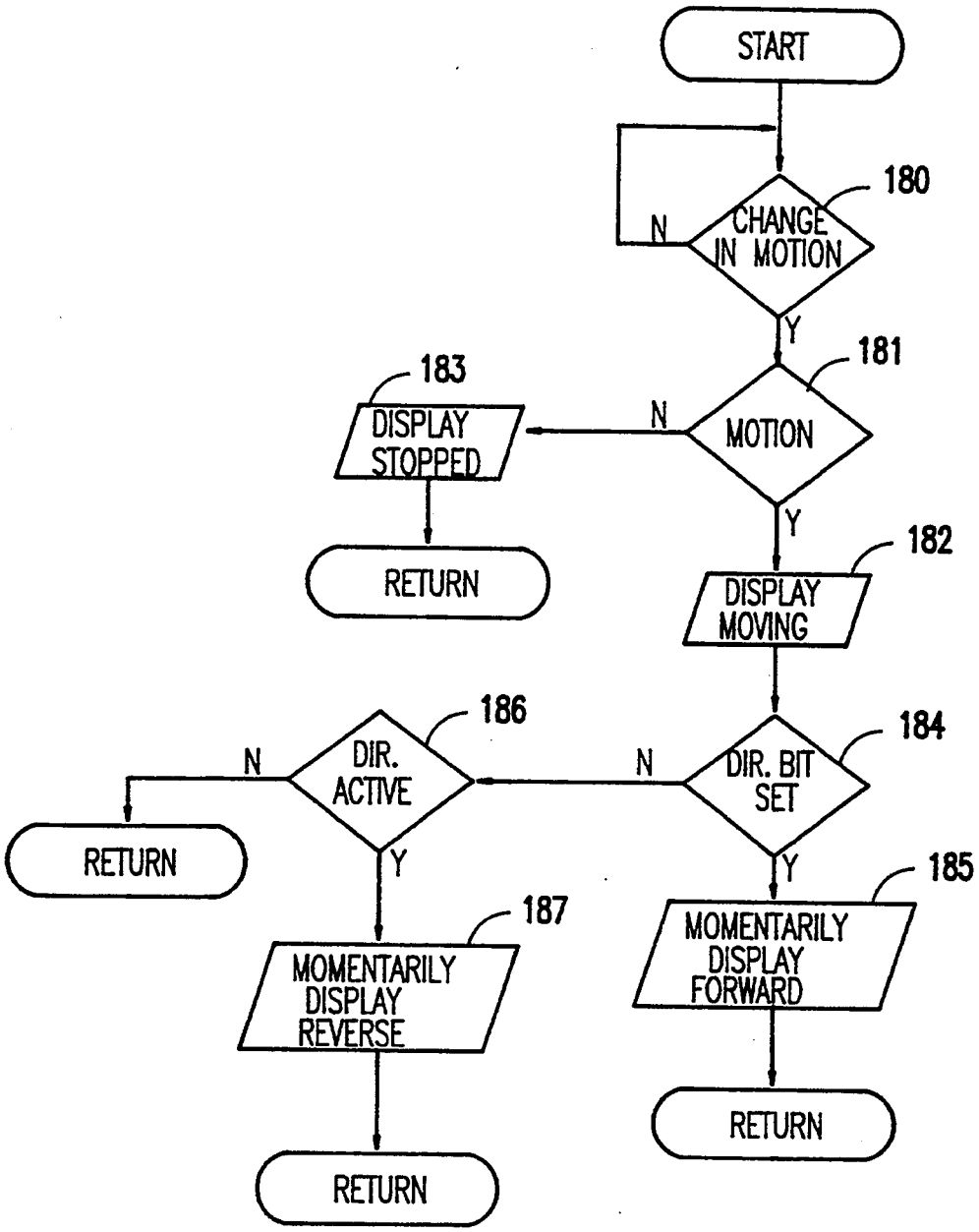
FIG. 18 is a flow diagram of the processing of motion information by the HOT unit.

In FIG. 18, the logic for the detection of direction information is shown. Motion sensor output is monitored in decision block 180 and when a change in motion is detected, a test is made in decision block 181 to determine if motion information is detected. If so, the display "MOVING" is illuminated in output block 182; otherwise the display "STOPPED" is illuminated in output block 183. If motion is detected, a further test is made in decision block 184 to determine whether a the direction bit is set to a "1" If so, the display "FORWARD" is momentarily illuminated in output block 185, and a return is made, but if not, a test is made in decision block 186 to determine if, for the dialed in ID, the direction change bit is active, i.e., the direction change bit has ever been a "1" If so, the display "REVERSE" is momentarily illuminated in output block 187, and a return is made; otherwise, a return is made directly.

The HOT unit looks at the following two bits in the EOT transmission to determine whether or display a direction message along with the LED motion indicator: the motion status bit and the motion detection bit. The table below shows the motion status bit as the leftmost bit. Direction is displayed only when any of the following four state changes are seen in the EOT transmission:

10→11—FORWARD

10→0 1—REVERSE

11→0 1—REVERSE

01→11—FORWARD

Figure 19:
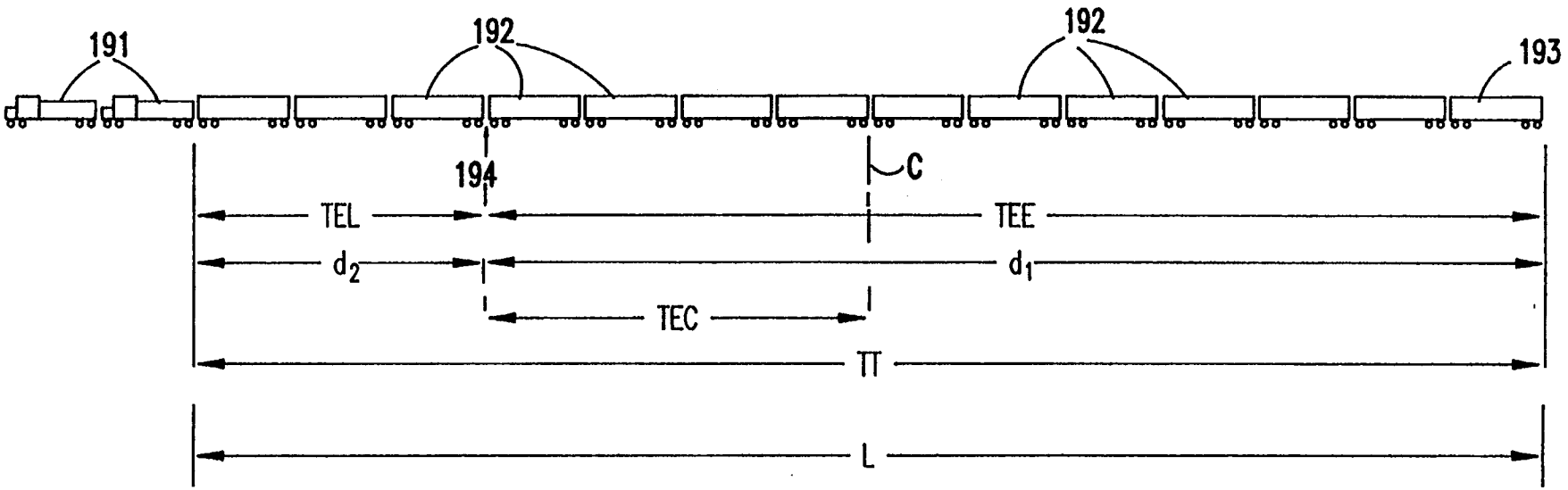
FIG. 19 is a pictorial representation of a train useful to illustrate the basic problem of locating the source of an undesired emergency (UDE) fault.

FIG. 19 illustrates the basic problem of locating the source of an undesired emergency (UDE) brake event. The train 190 is composed of locomotives 191 and a plurality of cars 192. A HOT unit (Locomotive Control Unit (LCU)) is mounted in at least the controlling locomotive, and an EOT unit is mounted on the last car 193 in the train. In the illustrated example, a UDE fault occurs at 164. The train has length, L, which is known. For the initial analysis, it is assumed that the speed of the UDE pressure wave travels along the train with a constant speed. Knowing the length, L, of the train, the total time, TT, of propagation along the train from front to rear is known. Measured from the UDE 194, the time it takes for the pressure wave to propagate to the locomotive 191, TEL, a distance $d_2$, plus the time it takes for the pressure wave to propagate to the end 193 of the train, TEE, a distance $d_1$, is equal to TT. Now, if a pressure wave were to propagate from the center, C, of the train to the locomotive, the time would be $$\frac{TT}{2} \text{ or } \frac{TEL + TEE}{2}.$$

The time, TEC, of propagation from the UDE to the center of the train can be computed as C-TEL, but $$C = \frac{TEL + TEE}{2},$$

so by substitution $$TEC = \left(\frac{TEL + TEE}{2}\right) - TEL,$$

and 2TEC=TEL+TEE−2TEL or TEE-TEL. Solving for TEC, $$TEC = \frac{TEE - TEL}{2},$$

and defining TEE-TEL as ΔT, $$TEC = \frac{\Delta T}{2}$$

which is independent of train length. By solving for $$\frac{\Delta T}{2}$$

and multiplying this value times 920 ft./sec., the constant rate of propagation of a pressure wave in the brake pipe, the distance of the UDE fault from the center of the train is computed. The sign of the answer indicates the direction, i.e., toward the front or toward the rear, from the center, C, where the UDE fault occurred.

The principle behind the calculations is that a UDE that does not occur at the center of the train has to travel a certain amount of extra time, called ΔT, to the fartherest end of the train, and the travel time to the closest end of the train is correspondingly decreased by the stone ΔT. Thus, the time measured by the HOT unit is 2ΔT, and the time from the center to where the UDE occurred is ΔT, or the time measured by the HOT unit divided by two. This is the principle of the procedure proposed by the Canadian Air Brake Club and implemented in the patent to Clements, discussed above.

These calculations are for an ideal brake system in which there are no air leaks. However, in any train there are air leaks in the brake system, typically at hose connections and brake valves. These may be small leaks individually, but in a long train these small leaks can amount to a substantial amount of leakage. Normally, this is no problem since the locomotive is quite capable of supplying air that makes up for the lost air along the brake pipe to maintain a specific pressure in the brake pipe. Thus, there is always air flowing in the brake pipe, and the rate of air flow has an effect on the rate of propagation of the pressure wave in a UDE event. Since air flows from the locomotive toward the end of the train, the propagation speed of the pressure wave from the point of the UDE toward the front of the train will always be less than the propagation speed of the pressure wave from the point of the UDE toward the end of the train. This, in turn, causes errors in the calculations used to determine the location of the UDE.

This invention compensates for the inaccuracies of the computation of the UDE location in either one of two ways. The first, and simplest, is to determine by empirical measurement an average value for most trains for the propagation velocities of pressure waves in a direction from front to rear and in a direction from rear to front, This has been done with the result, for the sample measured, that the average propagation velocity of a pressure wave in the direction from the front to rear of a train is 969 ft./sec., and the average propagation velocity of a pressure wave in the direction from the rear to the front of the train is 867 ft./sec. The equations therefore must be modified in order to reflect this difference in propagation velocities.

With reference again to FIG. 19, if $\rho_1$ is the rate of propagation from the front to rear of the train (i.e., 969 ft./sec.) and $\rho_2$ is the rate of propagation from the rear to front of the train (i.e., 867 ft./sec.), then $\rho_1 \times TEL = d_1$ and $\rho_2 \times TEE = d_2$, where $d_1 + d_2 = L$ the length of the train. The length, L, of the train is known since the engineer is provided with thumbwheel switches or other appropriate input means to enter the train length. With this information, the HOT unit can convert the calculated distance relative to the center of the train to a distance measured from the locomotive or, $\Delta T = TEE - TEL$ or $TEE = \Delta T + TEL$. Therefore, substituting for $d_1$, and $d_2$, $\rho_1 \times TEL + \rho_2 \times (\Delta T + TEL) = L$. Since the propagation constants, $\rho 1$ and $\rho 2$, and the length of the train, L, are known and $\Delta T$ can be measured, the only unknown in this equation is TEL. Solving for TEL yields $$TEL = \frac{L - \rho_2 \Delta T}{\rho_1 + \rho_2}$$

Multiplying TEL times the propagation constant $\rho_2$ provides $d_2$, or the distance from the front of the train to the origin of the UDE. It will of course be understood that, by different substitution in the equations, the distance $d_1$ from the origin of the UDE to the end of the train can also be computed.

The second way to compensate for the inaccuracies of the computation of the location of a UDE event according to the invention is similar to the first way just described except that average values for $\rho_1$ and $\rho_2$ are not used. Instead, an empirical table of values are stored in the HOT unit. This table is generated by measuring propagation constants for different air flow rates in train brake pipes. The outlet of the air manifold which supplies air to the brake pipe is provided with an air flow sensor which is connected to the HOT unit. Prior to starting a ran, the HOT unit is initialized, and as part of the initialization process, the HOT unit reads the signal provided by the air flow sensor. This value is then used to address the table of propagation values to read out $\rho_1$ and $\rho_2$ for that air flow value. Thereafter, the computations are the same as described above. It may be necessary after a braking event in which the train has been stopped to again initialize the HOT unit to update the values for $\rho_1$ and $\rho_2$ in the event that air flow has changed, but this is optional.

Figure 20:
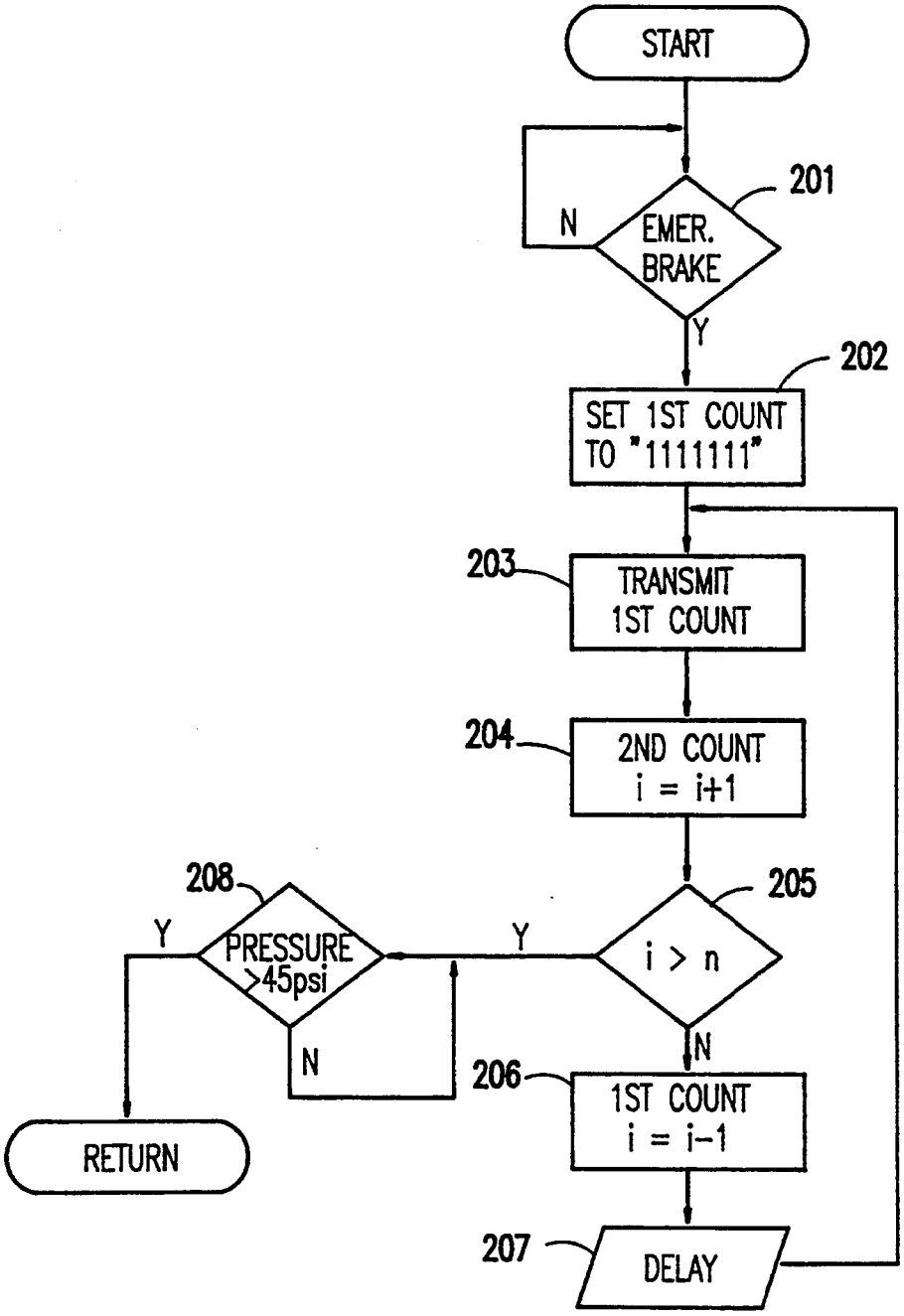
FIGS. 20 and 21 are flow diagrams illustrating the EOT time stamp processes for one-way and two-way EOT units, respectively.

In order to perform the computations, it is necessary to know, in addition to $\rho_1$ and $\rho_2$, the train length, L, and $\Delta T$. As mentioned, the train length, L, is dialed into the HOT unit by the engineer, and $\Delta T$ is measured at the time a UDE occurs. This measurement involves a timestamp process. FIG. 20 is a flow diagram of a first timestamp process implemented at the EOT unit. This implementation is suitable for one-way EOT units. The process begins by detection in function block 201 whether a UDE event has occurred. This is typically derived from the pressure information, i.e., pressure information transmitted by the EOT indicating a pressure drop to less than 25 psi in less than two seconds. When an emergency brake event is detected, the EOT unit then begins to transmit to the HOT unit a time stamped indication of the detection of the event. In the process shown in FIG. 20, this is done by first presetting a first counter to decimal "127" (i.e., binary "1111111") in function block 202 and, in function block 203, transmitting the count in the first counter in the first seven discretionary bits of the fifth byte of the code format shown in FIG. 6. A second counter is incremented by "1" with each transmission in function block 204, and in decision block 205, a test is made to determine whether the count of the second counter has exceeded some preset count. If not, the count in the first counter is decremented by one in function block 206, and, after a predetermined fixed period of time, say one second, has passed in operation block 207, a return is made to function block 203. The reason for the first counter counting down is to allow the HOT unit to distinguish this UDE "timestamp" from the other uses of the seven discretionary bits. The HOT additionally recognizes that a UDE event is being transmitted by the EOT unit because of the pressure information being transmitted. Thus, the EOT unit will continue to transmit at predetermined time intervals the count of the first counter. The count in turn may be decoded by the HOT unit to determine exactly when the emergency brake event was detected by the EOT unit. This procedure of repeatedly transmitting the timestamp, decremented by one in each transmission, allows the HOT unit to determine the correct time of the UDE event as sensed by the EOT unit even if several transmissions are lost due to interference and/or collisions. When the count in the second counter exceeds a preset count, the EOT unit UDE function is disabled until the brake pipe pressure exceeds 45 psi. This is detected in decision block 208. When a pressure of 45 psi is detected, the process returns to normal operation.

Figure 21:
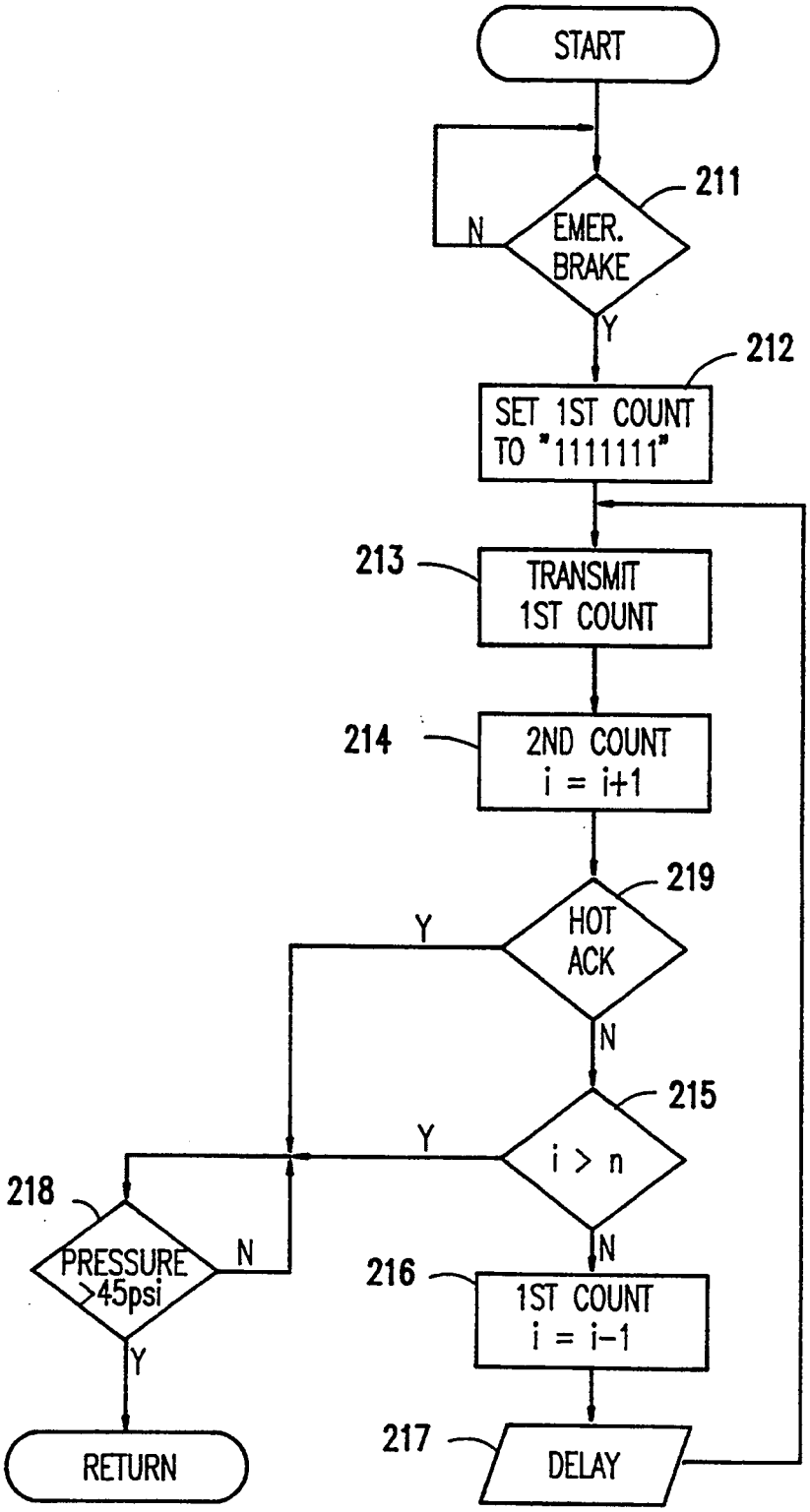

This basic process is enhanced when a two-way EOT unit is used, as shown by the flow diagram in FIG. 21. The process is the same to function block 211; however, since a two-way EOT unit can receive as well as transmit, the process is modified to test for an acknowledgement from the HOT unit in decision block 219. If no acknowledgement has been received, then the process continues as described with reference to FIG. 20. On the other hand, if an acknowledgement is received from the HOT unit, the EOT unit UDE function is enabled again after a pressure of 45 psi is detected in decision block 218. Thus, if either an acknowledgement is received from the HOT unit or the second counter counts to a predetermined count, whichever occurs first, the EOT unit is returned to normal operation.

Figure 22:
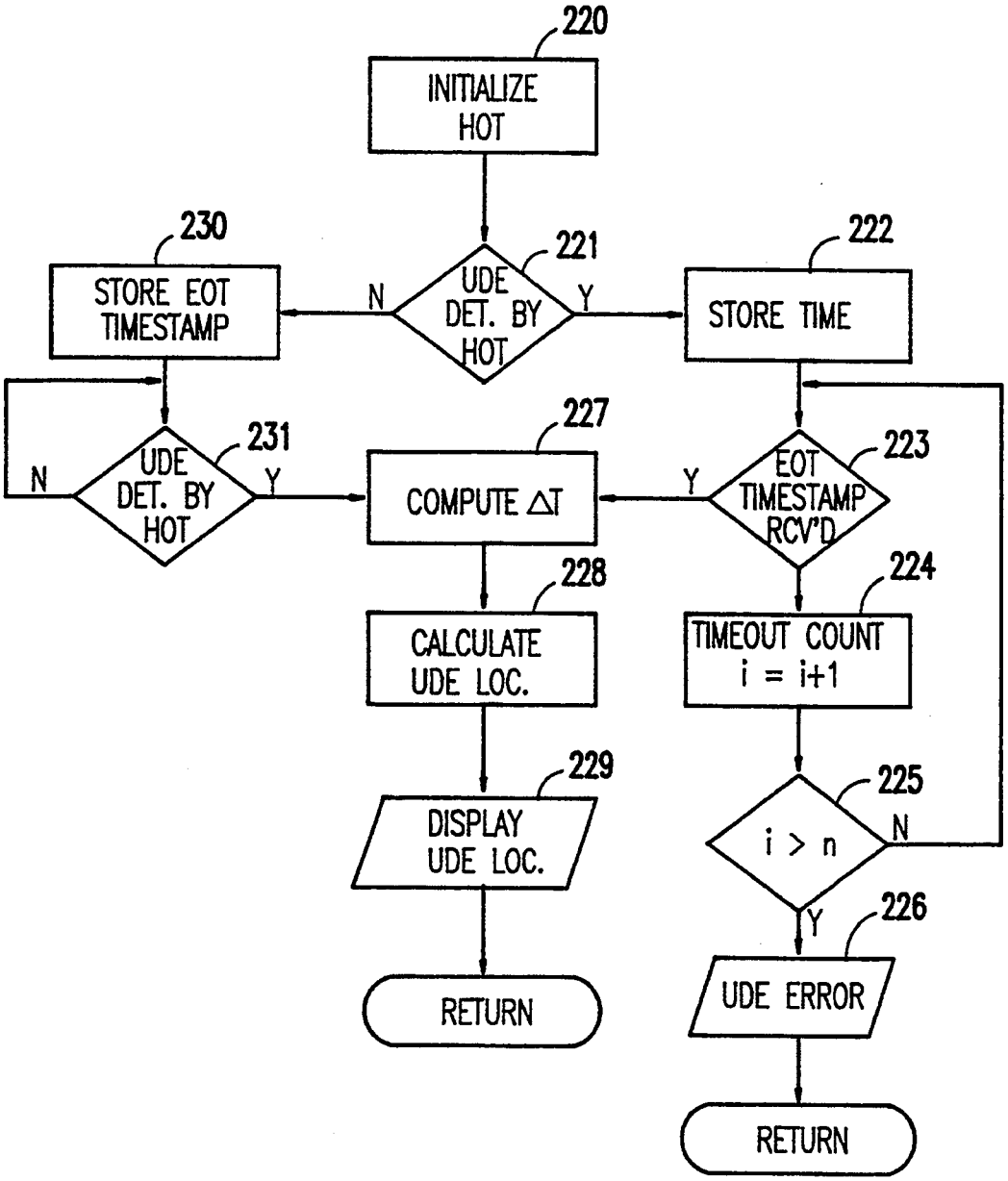
FIG. 22 is a flow diagram of HOT calculation of UDE fault location according to a second aspect of the invention.

FIG. 22 is a flow diagram showing the UDE calculation performed at the HOT unit. The process begins in function block 220 where the HOT unit is initialized. This process includes reading in values for $\rho_1$ and $\rho_2$. As described above, these values may be fixed, average values or they may be accessed from a table of values based on a reading from an air flow signal from the air manifold supplying the brake pipe. The UDE calculation begins at decision block 221 where a decision is made as to whether detection of an undesired emergency brake event is first made by the HOT unit. If the UDE occurred closest to the locomotive, the HOT unit would detect the event before the EOT unit. The HOT unit makes this detection as a result of a priority interrupt to the HOT unit's microprocessor from pressure switch 48 (FIG. 1) having threshold of less than 25 psi. If the HOT unit makes the detection first, the time of detection by the HOT unit is temporarily stored in function block 222. Then a check is made in decision block 223 to see if a time stamped transmission has been received from the EOT unit. If not, a timeout counter is incremented in function block 224 followed by a test in decision block 225 to determine if the timeout counter has timed out. If no timeout has occurred, then a return is made to decision block 223, but if a timeout has occurred, a display "UDE error" is illuminated in output block 226 and a return is made.

Assuming, however, that a time stamped transmission is received from the EOT unit, the time differential, $\Delta T$, between the time of detection of the emergency brake event as detected by the HOT unit and the time of detection of the emergency brake event as detected by the EOT unit is computed in function block 227. The signed value of $\Delta T$ is then multiplied by the appropriate propagation constant as part of the calculation of TEL (or TEE) which yields $d_1$ in function block 228 according to the calculations described above. The resulting distance in feet from the front of the train is displayed by the HOT unit in function block 229. Thus, the HOT unit automatically displays for the engineer the approximate location of the origin of a UDE from the front of the train. As a further enhancement and given an average length of car, the approximate car number where the fault occurred may be displayed.

Assuming that the UDE is first detected by the EOT unit, as determined in decision block 221, the EOT timestamp is temporarily stored in function block 230. Then the HOT unit waits at decision block 231 until the UDE is detected by the HOT unit. When this occurs, the HOT unit then enters the computation process at function block 227.

Figure 23:
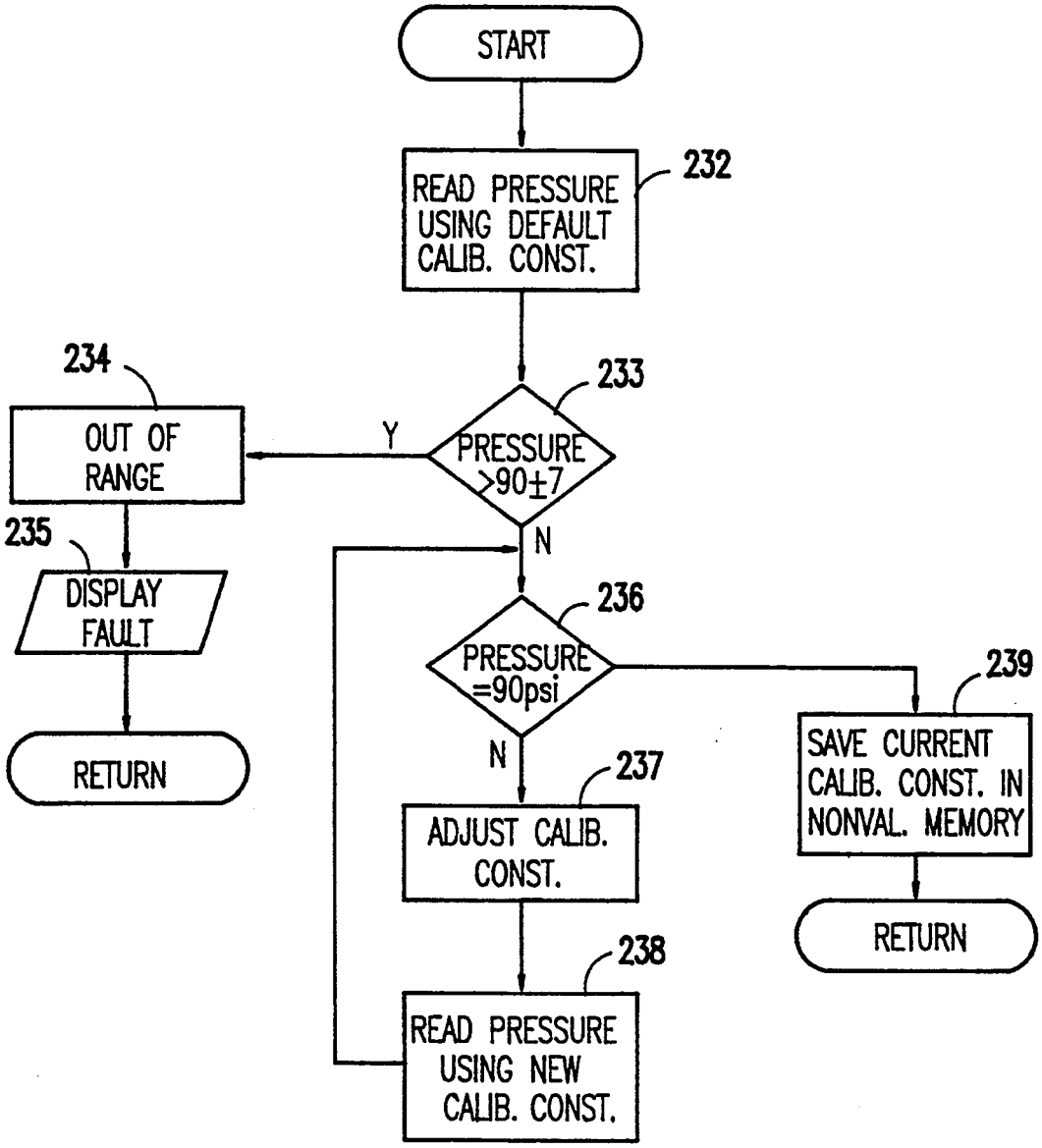
FIG. 23 is a flow diagram of automatic EOT pressure calibration according to another aspect of the invention.

FIG. 23 is a flow diagram of the automatic EOT pressure calibration according to another aspect of the invention. The EOT unit is calibrated using a stable air pressure source of 90.0 psi connected to the EOT unit's glad hand air connector. The calibration process begins by reading the air pressure using a default calibration constant in function block 232. Then, in decision block 233, the pressure read is checked to see if it is outside the range of 83 psi to 97 psi, e.g., 90 psi $\pm 7$ psi. If so, the pressure is declared outside the acceptable range in function block 234, and the calibration procedure ends with an out of range message displayed at output block 235, and the unit will need to be repaired. If, on the other hand, the pressure read is within this range, a further test is made in decision block 236 to determine if the read pressure is equal to 90 psi. If not, the calibration constant is adjusted in function block 237, and the pressure is read again in function block 238 using the new calibration constant. A return is made to decision block 236, and the process is repeated until the pressure read is equal to 90 psi as a result of iterative adjustments of the calibration constant. When the pressure read is equal to 90 psi, the current calibration constant is saved in nonvolatile memory in function block 239, and a return is made.

While the invention has been described in terms of several preferred embodiments, those skilled in the art will recognize that the invention can be practiced with modification within the spirit and scope of the appended claims.

Having thus described our invention, what we claim as new and desire to secure by Letters Patent is as follows:

1. An End of Train (EOT) and Head of Train (HOT) railroad telemetry system wherein an EOT unit includes means for transmitting a signal to a HOT unit when an Undesired Emergency (UDE) brake event due to venting of air in a train brake pipe to atmosphere is detected at the EOT unit, and further comprising at the HOT unit:

means for storing different propagation constants representing differences in propagation rates in directions from a front to a rear of the train and from the rear to the front of the train due to air flow in said brake pipe;

means for detecting the UDE at the HOT unit;

means for measuring a time differential between times when the UDE is detected at the EOT and HOT units;

means, using the measured time differential and the stored different propagation constants, for automatically calculating an approximate location where the UDE originated.

2. The End of Train (EOT) and Head of train (HOT) railroad telemetry system recited in claim 1 wherein said EOT unit includes means for generating a first time stamp when a UDE brake event is detected by the EOT unit, said time stamp being transmitted to the HOT unit as part of said signal, and said HOT unit further including means for generating and temporarily storing a second time stamp when the UDE brake event is detected by the HOT unit, said first and second time stamps being used to measure said time differential.

3. The End of Train (EOT) and Head of Train (HOT) railroad telemetry system recited in claim 2 wherein the HOT and EOT units communicate with a protocol including discretionary bits which are used in normal transmissions from the EOT unit to the HOT unit for status or condition information, said EOT unit including means for alternatively using said discretionary bits in a Rear-to-Front transmission as said first time stamp to be transmitted from the EOT unit to the HOT unit in the event of an Undesired Emergency (UDE)event.

4. A method used in End of Train (EOT) and Head of Train (HOT) railroad telemetry systems in which an EOT unit includes means for transmitting a signal to a HOT unit in the event of an Undesired Emergency (UDE) brake event due to venting of air in a train brake pipe to atmosphere, said method performed by said HOT unit and comprising the steps of:

storing different propagation constants representing differences in propagation rates in directions from a front to a rear of the train and from the rear to the front of the train due to air flow in said brake pipe;

detecting at said HOT unit a UDE brake event;

measuring a time differential between times when the UDE is detected at the EOT and HOT units; and computing from the measured time differential and the stored different propagation constants an approximate location where the UDE originated.

5. The method recited in claim 4 further comprising the steps of:

time stamping at the EOT unit a time of detection of a UDE brake event to generate a first time stamp;

transmitting said first time stamp from the EOT unit to the HOT unit;

time stamping at the HOT unit a time of detection of a UDE brake event to generate a second time stamp; and temporarily storing said second time stamp;

wherein said step of measuring the time differential is performed by calculating a difference between said first and second time stamps.

6. The method recited in claim 5 wherein the HOT and EOT units communicate with a protocol including discretionary bits which are used in normal transmissions from the EOT unit to the HOT unit for status or condition information, said method further comprising the step at the EOT unit of alternatively using said discretionary bits in Rear-to-Front transmission as said first time stamp to be transmitted from the EOT unit to the HOT unit in the event of an Undesired Emergency (UDE) brake event.

* * * * *